US007241543B2

(12) United States Patent
Sakimura et al.

(10) Patent No.: US 7,241,543 B2
(45) **Date of Patent: *Jul. 10, 2007**

(54) IMAGE FORMING METHOD, A PHOTORECEPTOR USED FOR THE APPARATUS, AND AN IMAGE FORMING UNIT

(75) Inventors: Tomoko Sakimura, Hino (JP); Toyoko Shibata, Zama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/215,328

(22) Filed: Aug. 30, 2005

(65) Prior Publication Data

US 2006/0088777 A1 Apr. 27, 2006

(30) Foreign Application Priority Data

Oct. 26, 2004 (JP) ..... 2004-310588

(51) Int. Cl.
*G03G 15/02* (2006.01)

(52) U.S. Cl. ..... 430/56; 430/120; 430/58.05; 430/58.85

(58) Field of Classification Search ..... 430/56, 430/120, 58.05, 58.85
See application file for complete search history.

(56) References Cited

U.S. PATENT DOCUMENTS

| | | | |
|---|---|---|---|
| 6,472,117 | B1 | 10/2002 | Kohyama et al. |
| 6,630,566 | B1 | 10/2003 | Allen et al. |
| 6,858,703 | B2 | 2/2005 | Allen et al. |
| 2004/0054095 | A1 | 3/2004 | Allen et al. |

FOREIGN PATENT DOCUMENTS

| | | |
|---|---|---|
| JP | 6-020235 | 1/1994 |
| JP | A 6-202357 | 7/1994 |
| JP | 2003-255585 | 9/2003 |

*Primary Examiner*—Mark A. Chapman
(74) *Attorney, Agent, or Firm*—Lucas & Mercanti, LLP

(57) ABSTRACT

An electrophotographic image forming method is disclosed in which toner has a number ratio of toner particles having a shape coefficient of 1.2 to 1.6 being at least 65 percent, a variation coefficient of the shape coefficient of 4 to 16%, and a number variation coefficient in the toner number particle size distribution of 8 to 27 percent, and charge generation material used in the photoreceptor contains a mixture compound represented by Formula 1 in which n has a range of distribution and (x+y) is not more than 99% when x represents the ratio of a component having the largest content and y represents the ratio of a component having the second content, $$X\text{-}(CTM\text{-}group)_n\text{-}Y: \qquad \text{Formula (1)}$$

CTM-group is a charge transfer group; X and Y are each a hydrogen atom, a halogen atom or a mono-valent organic group; and n is an integer of from 0 to 10.

19 Claims, 3 Drawing Sheets

IMAGE FORMING METHOD, A PHOTORECEPTOR USED FOR THE APPARATUS, AND AN IMAGE FORMING UNIT

FIELD OF THE INVENTION

The present invention relates to an image forming apparatus employing a toner composed of small particles of a uniform diameter as well as an electrophotographic photoreceptor, and an image forming unit which is employed for the above apparatus, and an image forming method.

RELATED ART

Heretofore, known as a system to transfer a toner image on an electrophotographic photoreceptor (hereinafter also referred simply to as a photoreceptor) onto a recording material to form a final image, has been a system which transfers a toner image formed on an electrophotographic photoreceptor directly onto a recording material. Further, known has been an image forming system employing an intermediate transfer body. In the latter system, another transfer process is included which transfers a toner image from the electrophotographic photoreceptor onto a recording material, and after performing the primary transfer from electrophotographic photoreceptor onto the intermediate transfer body, the primary transfer image on the intermediate transfer body is subjected to secondary transfer onto another recording material, whereby a final image is produced. The above intermediate transfer system is often employed as a separate color toner image superimposition transfer system in a so-called full color image forming apparatus in which an original image which has been subject to color separation is reproduced employing the color subtractive process using color toners such as a black toner, a cyan toner, a magenta toner, and a yellow toner.

On the other hand, a recent image forming method utilizing an electrophotographic system has been applied to printers of personal computers, and hard copy printers, and due to ease of image processing and ease of development of composite machines, digital system image forming methods which use LED and lasers as an image exposure light source has been increasingly employed. Further, along with the progress of achieving the formation of highly detailed images, techniques have been developed to produce high quality electrophotographic images. For example, the following technique is disclosed (refer for example to Patent Document 1). Image exposure is performed utilizing a laser beam of a small spot area to enhance the density of a dot latent image, whereby a highly detailed latent image is formed. The resulting latent image is developed employing a toner composed of small diameter particles to produce electrophotographic images of high quality. Under such situations, recently, due to the use of the toner composed of small diameter particles, which is suitable for low temperature fixing, cases have increased in which various problems surface.

When charge transport materials exhibiting high mobility and desired high speed response are employed in an electrophotographic photoreceptor and a toner composed of small diameter particles of is employed to achieve the formation of images of high quality, toner filming tends to result, and specifically, when high speed image formation is preformed at high temperature and high humidity, the above tendency is more pronounced (refer for example to Patent Document 2).

On the other hand, when high speed development is performed employing the toner composed of particles of a small diameter to achieve high image quality of finished images, it has been discovered that uneven development results, due to the assumed reasons such as minute fluctuation of static charge build-up and non-uniformity of the surface of photoreceptors. Specifically, due to the above, fine line reproductions and sharpness of the edge portions of detailed images are degraded, and this tendency is more pronounced when images are formed at low temperatures and low humidity.

Patent Document 1: JP A 2003-255585

Patent Document 2: JP A 6-202357

SUMMARY

An object of this invention is to provide a useful image forming apparatus, photoreceptor, image forming unit and image forming method.

An embodiment is described.

An image forming method comprising;

developing a latent image on a photoreceptor by a developer containing a toner to form a toner image on the photoreceptor, wherein toner particles of the toner have a number ratio of toner particles having a shape coefficient of 1.2 to 1.6 being at least 65 percent, a variation coefficient of the shape coefficient is 4 to 16%, and a number variation coefficient in number particle size distribution of 8 to 27 percent; and the photoreceptor has photosensitive layer containing a charge generation material and a charge transfer material, and charge generation material contains a mixture compound represented by Formula 1 in which n has a range of distribution and (x+y) is not more than 99% wherein x represents the ratio of a component having the largest content and y represents the ratio of a component having the second content, $$X\text{-}(CTM\text{-}group)_n\text{-}Y \qquad \text{Formula (1)}$$

wherein CTM-group is a charge transfer group; X and Y are each a hydrogen atom, a halogen atom or a mono-valent organic group, X and Y may the same or different; and n is an integer of from 0 to 10, provided that n is 1 to 10 when both X and Y are a hydrogen or halogen atom at the same time.

DETAILED DESCRIPTION

Figure 1:
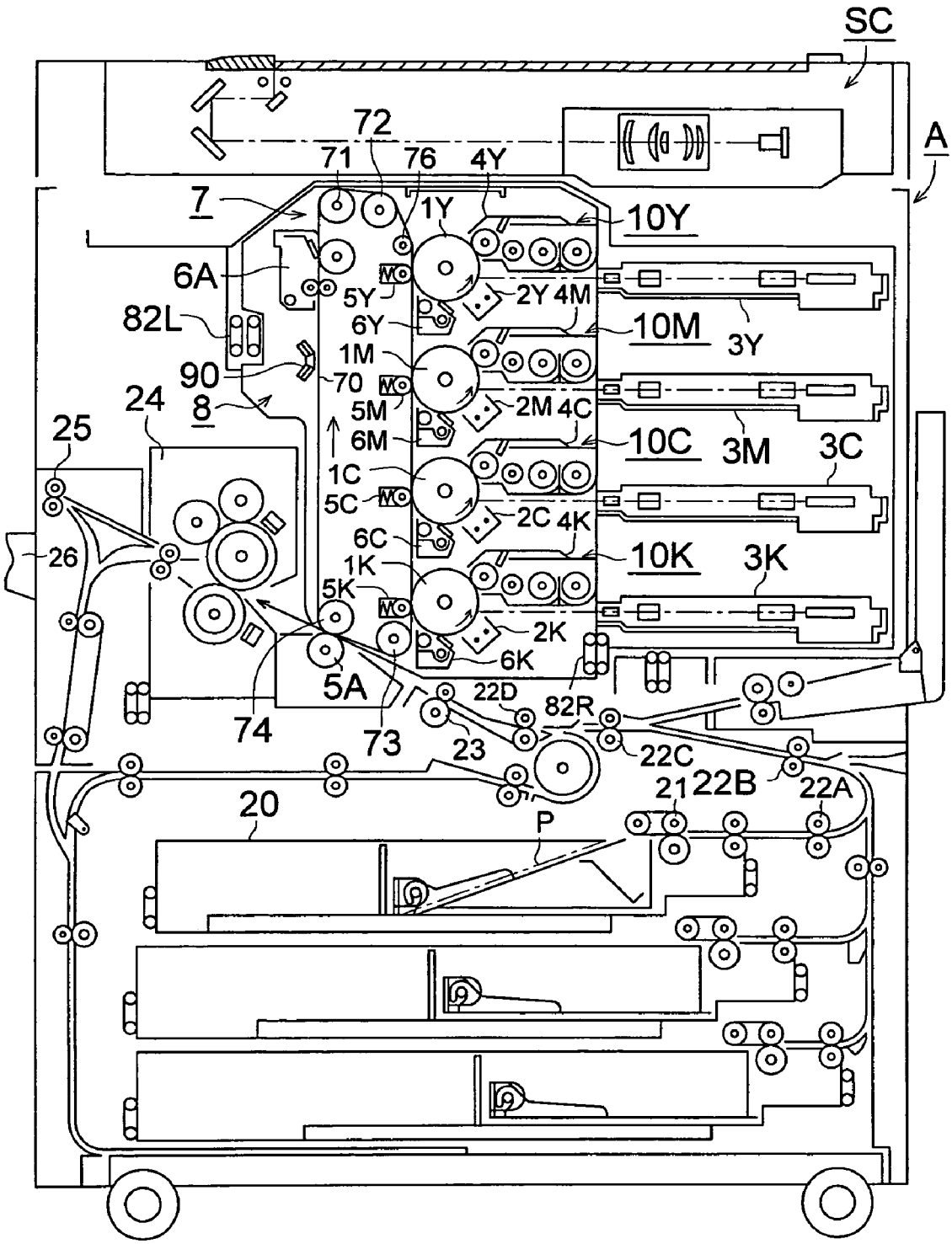
FIG. 1 is a cross-sectional construction diagram of a color image forming apparatus, showing an embodiment of the invention.

One of exemplary embodiments is shown as follows.

An image forming method comprising;

charging a photoreceptor uniformly a photoreceptor, exposing the photoreceptor to form a latent image, developing the latent image by a developer containing a toner to form a toner image, transferring the toner image to an recording member, and fixing the toner image, wherein the toner particles of the toner have a number ratio of toner particles having a shape coefficient of 1.2 to 1.6 being at least 65 percent, a variation coefficient of the shape coefficient is 4 to 16%, and a number variation coefficient in the toner number particle size distribution of 8 to 27 percent; and the photoreceptor has photosensitive layer containing a charge generation material and a charge transfer material, and charge generation material contains a mixture compound represented by Formula 1 in which n has a range of distribution and (x+y) is not more than 99% when x represents the ratio of a component having the largest content and y represents the ratio of a component having the second content, $$X\text{-}(CTM\text{-}group)_n\text{-}Y \qquad \text{Formula (1)}$$

wherein CTM-group is a charge transfer group; X and Y are each a hydrogen atom, a halogen atom or a mono-valent organic group; and n is an integer of from 0 to 10, provided that n is 1 to 10 when both X and Y are a hydrogen or halogen atom at the same time.

This invention was proposed to dissolve the problem mentioned before, and has been found in the procedure of investigating countermeasure to image disadvantage of lowering image density due to potential fluctuation of solid black image, degradation of sharpness due to character thinning by reversal development, which is apt to be caused at high speed copying or at a condition of low temperature and low humidity in an electrophotographic image forming.

The image forming method proposed by the inventors can exhibit excellent in fine line reproduction under both low temperature and low humidity condition or high temperature and high humidity condition, having high image quality and high transfer efficiency and minimized toner filming on the photoreceptor and intermediate transfer member surface.

Reasons for the embodiments resulting in marked desired effects have not been yet clarified, but the inventors of the present invention assume what is described below.

The charge transfer material is a mixture of charge transport materials exhibiting a distribution of the molecular weight and exhibits the feature of high solubility in solvents. Namely, the above charge transfer material exhibits high solubility in solvents employed during the production. Further, it is uniformly compatible with binders to form a charge transport layer due to its high affinity with binder resins, whereby a highly uniform charge transport layer is formed. When the resulting photoreceptor is charged, it is highly uniformly charged, whereby any minute unevenness of electrostatic charge is not formed on the surface of the photoreceptor. Due to that, during exposure, even in highly detailed portions, a latent image exhibiting a constant potential is precisely formed. Consequently, when the above latent image is developed by a toner composed of particles of a small diameter, which exhibits constant static-charge buildup, a highly detailed image is prepared as a final image.

On the other hand, during formation of developed images, an electrostatically adhered toner, when the above toner is composed of particles of a uniform diameter and exhibits uniform characteristics due to the absence of minute powders, results in markedly uniform adhesion force. Consequently, the remaining toner after transfer of the toner adhered to the photoreceptor employing development is completely removed by a constant cleaning force, whereby filming does not result due to the absence of the remaining toner.

In addition, when electrostatic potential on a photoreceptor is constant in any place and there is no place in which the electrostatic potential is locally higher, during cleaning, force which is required to press the cleaning blade on the surface of the photoreceptor becomes not so large. In the photoreceptor, as noted above, the affinity between the charge transport materials and binder resins is relatively high, while the affinity with toner binders which constitute the toner, additives or paper powder is relatively low. As a result, it is assumed that filming tends to not occur. Further, it is assumed that the use of toner composed of uniform diameter particles, which incorporates no minute toner powders works advantageously in this aspect.

Further, in the case of the presence of a protective layer on the surface, the molecular affinity between the charge transport materials and the resins of the transport layer is relatively large, and adhesion force with the protective layer is also relatively large. As a result, charge trap sites decrease to improve repeating characteristics at a high speed and to lower fog formation.

An image forming apparatus exhibiting fine line reproduction, high transfer efficiency and minimized toner filming on the photoreceptor and the intermediate transfer member even when images are formed at a condition of low temperature and low humidity or a condition of high temperature and high humidity, and a photoreceptor used for the apparatus, an image forming unit and an image forming method, are provided. The photoreceptor is suitably applied to a high speed image forming apparatus wherein the photoreceptor rotates at line speed on the photoreceptor surface of 250 mm/s or more, because of the high sensitivity.

Elements of embodiments are described.

The image forming apparatus employs a developing device of photoreceptor containing a specific charge transfer material and a toner having a number ratio of toner particles having a shape coefficient of 1.2 to 1.6 being at least 65 percent, a variation coefficient of the shape coefficient of the toner is 4 to 16%, and a number variation coefficient in the number particle size distribution of 8 to 27 percent, in combination. An image can be reproduced clearly without blurring and no toner filming is generated even under a high temperature and high humidity condition by employing such combination.

Photoreceptor

The photoreceptor comprises at least a charge generation layer containing a charge generation material, a charge transfer layer containing a charge transfer material and a protective layer, if necessary. It is preferable that the photoreceptor has a protective layer at outermost of the photoreceptor.

Charge Generation Material

The charge generation material is represented by Formula 1 in which n has a range of distribution and (x+y) is not more than 99% when x represents the ratio of a component having the largest content and y represents the ratio of a component having the second content.

$$X\text{-}(CTM\text{-}group)_n\text{-}Y \qquad \text{Formula (1)}$$

In Formula 1, CTM-group is a charge transfer group; X and Y are each a hydrogen atom, a halogen atom or a mono-valent organic group; and n is an integer of from 0 to 10, provided that n is an integer of from 1 to 10 when both of X and Y are hydrogen atom or a halogen atom.

The value (x+y) being not more than 99% means that compounds having different chain structure number of charge transfer group (CTM group) exist in a mixture.

The charge transfer material is a mixture compound represented by Formula 1 in which n has a range of distribution and (x+y) is not more than 99% when x represents the ratio of a component having the largest content and y represents the ratio of a component having the second content, and the mixture contains at least three kinds of compound represented by the Formula 1.

The value (x+y) is not more than 99%, and preferably 90%≧x+y≧30%. The weight average molecular weight of the CTM is preferably 650 to 2,500, and more preferably 800 to 2,300. The weight average molecular weight is a value in terms polystyrene converted weight average molecular weight.

The CTM-group in Formula 1 is a group having drift mobility of electron or positive hole. In other word, the CTM-group is a group from which electric current caused the charge transfer can be detected by, for example, Time-Of-Flight method.

When the CTM-group cannot exist solely it self, the CTM-group may be included within the definition of the CTM-group if a compound of the CTM-group having a hydrogen atom at the both ends of thereof and represented by H(CTM-group)H has the charge transferring ability.

The mixture compound, represented by Formula 1 and having x+y being 99% or less in which x represents the ratio of a component having the largest content and y represents the ratio of a component having the second content, in a molecular distribution based on n, is represented by the following Formulas A, B and C, and such the mixture compound can be prepared by the later-mentioned synthesizing examples.

The compound represented by A has the following chemical structure.

Formula A

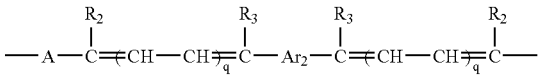

CTM-group

-continued

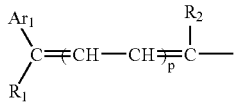

X

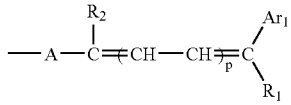

Y $Ar_1$ is a substituted or unsubstituted mono-valent aromatic group; $Ar_2$ is a substituted or unsubstituted di-valent aromatic group, a di-valent furan or thiophene group; or a group represented by Formula 2; $R_1$ through $R_3$ are each a hydrogen atom, a substituted or unsubstituted alkyl group or a substituted or unsubstituted mono-valent aromatic group; A is a di-valent group having a triarylamino group or a group represented by the following Formula 3. Each of the plural $Ar_1$, $R_1$, $R_2$ and $R_3$ may be the same with or different from each other, and p and q are each an integer of 0 or 1.

Formula 2

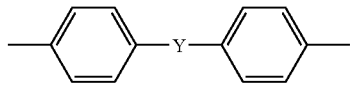

In the above, Y is a single bond, an oxygen atom, a sulfur atom, a —CH═CH— group or a —C($R_4$)($R_5$)— group, $R_4$ and $R_5$ each represents an alkyl group, and $R_4$ and $R_5$ may be bonded with together.

Formula 3

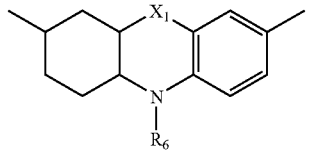

In the above, $X_1$ is a single bond, an alkylene group, an oxygen atom or a sulfur atom; and $R_6$ is a substituted or unsubstituted alkyl group or substituted or unsubstituted aromatic group.

Mixture compound of B has the following chemical structure.

Formula B

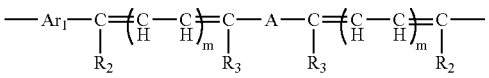

CTM-group

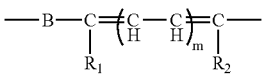

X

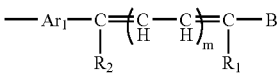

Y $Ar_1$ is a substituted or unsubstituted di-valent aromatic group, a di-valent furan or thiophene group or a group represented by Formula 2; $R_1$ through $R_3$ are each a hydrogen atom, a substituted or unsubstituted alkyl group or a substituted or unsubstituted mono-valent aromatic group; A is a divalent group having a triarylamino group or a group represented by Formula 3; and B is a substituted or unsubstituted mono-valent aromatic group, plural B, $R_1$, $R_2$ and $R_3$ each may be the same as or different from each other and m is an integer of 0 or 1.

In formulas A and B, the di-valent group having a triarylamino group is a group wholly having two bonding hands in which three bonding hands of the nitrogen atom each bonds with an aromatic ring.

In Formulas A and B, as the substituted or unsubstituted mono-valent group represented by $Ar_1$, a substituted or unsubstituted phenyl group and a substituted or unsubstituted naphthyl group are preferable; and the substituent of these groups is preferably an alkyl group having from 1 to 4 carbon atoms, an alkoxyl group, a phenyl group and a halogen atom.

As the substituted or unsubstituted di-valent group represented by $Ar_2$, a phenylene group, a naphthylene group and a biphenylene group are preferable; and a substituent of these groups is preferably an alkyl group. Preferable example of the $Ar_2$ is a phenyl group. A di-valent furan group and a di-valent thiophene group are also preferred.

$R_1$, $R_2$, and $R_3$ each represents a hydrogen atom, a halogen atom, a substituted or unsubstituted alkyl group, a substituted or unsubstituted alkoxyl group or a substituted or unsubstituted aromatic group, and preferably a hydrogen atom, an alkyl group and an alkoxyl group each having from 1 to 4 carbon atoms, a substituted or unsubstituted phenyl group or a phenyl group having a halogen atom or an alkyl group having from 1 to 4 carbon atoms.

The di-valent group represented by A is preferably a di-valent group having a triarylamino group represented by Formula 4 or Formula 6, additionally to the group represented by Formula 3.

Formula 4

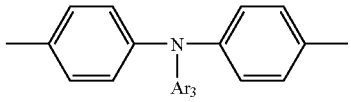

Formula 6

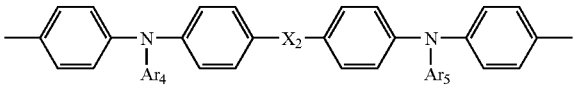

$Ar_3$ in the formula 4 is a substituted or unsubstituted mono-valent aromatic group $X_2$ in the formula 6 is a substituted or unsubstituted alkylene group, a substituted or unsubstituted divalent aromatic group, and $Ar_4$ and $Ar_5$ each is a substituted or unsubstituted monovalent aromatic group.

$A_6$ in the formula 3 is a substituted or unsubstituted alkyl group or a substituted or unsubstituted aromatic group, and preferably an alkyl group having from 1 to 4 carbon atoms or a phenyl group.

$Ar_3$ in the formula 4 is a substituted or unsubstituted mono-valent aromatic group, and preferably unsubstituted phenyl group or a phenyl group substituted with an alkyl group having from 1 to 4 carbon atoms or an alkoxyl group.

$Ar_4$ and $Ar_5$ are each a substituted or unsubstituted mono-valent aromatic group, and preferably an unsubstituted phenyl group or a phenyl group substituted with an alkyl group having from 1 to 4 carbon atoms or an alkoxyl group.

Typical chemical structure of the group represented by Formulas A and B are shown below. The mixture of the compounds or mixture compound each represented by the following structure and different from each other in the value of n are used as the charge transfer material. The compounds in which p or q in Formula A or m in Formula B are different each other are different compounds even if the chemical structures of them are the same. For example, one having the value of p or q of 0 and one having the value of p or q of 1 are different compounds even when the compounds each having the following structure 1A. Moreover, the compounds different the in the distribution from each other are different compounds even when the p or q is the same.

Concrete examples of the compound represented by Formula A

| Chemical structure No. | A | $Ar_1$ | $R_1$ | $Ar_2$ | $R_2$ | $R_3$ |
|---|---|---|---|---|---|---|
| 1A | 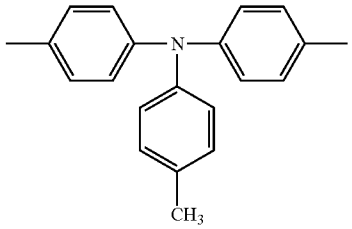 | 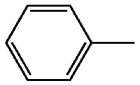 | H | 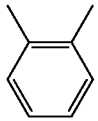 | H | H |
| 2A | 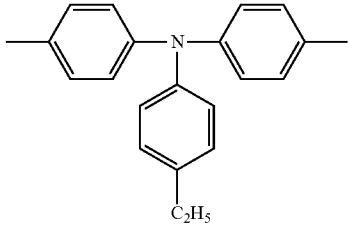 | 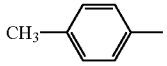 | H | 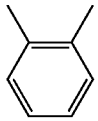 | H | H |
| 3A | 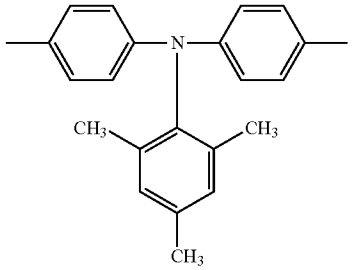 | 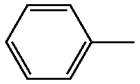 | H | 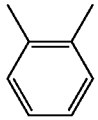 | H | 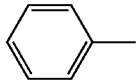 |

-continued
| Chemical structure No. | A | $Ar_1$ | $R_1$ | $Ar_2$ | $R_2$ | $R_3$ |
|---|---|---|---|---|---|---|
| 4A | 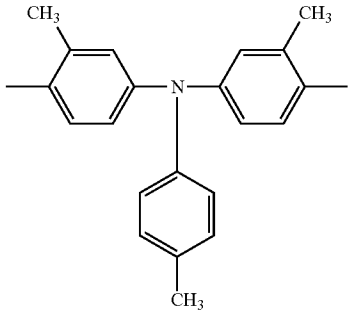 | 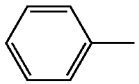 | 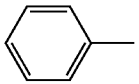 | 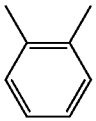 | H | H |
| 5A | 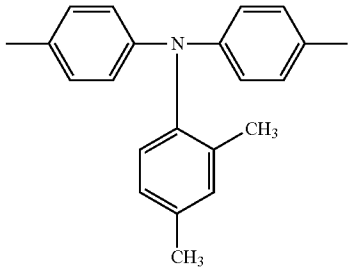 | 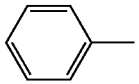 | 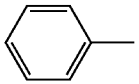 | 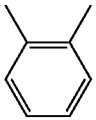 | H | H |
| 6A | 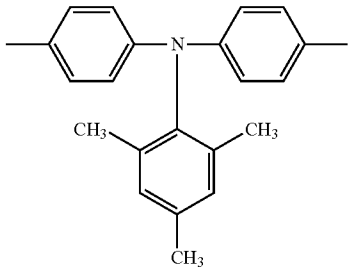 | 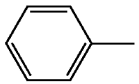 | 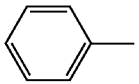 | 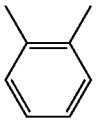 | H | H |

-continued
| Chemical structure No. | A | $Ar_1$ | $R_1$ | $Ar_2$ | $R_2$ | $R_3$ |
|---|---|---|---|---|---|---|
| 7A | 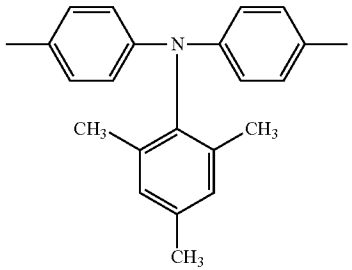 | 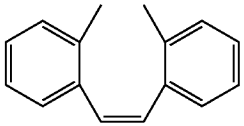 | | 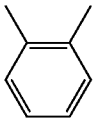 | H | H |
| 8A | 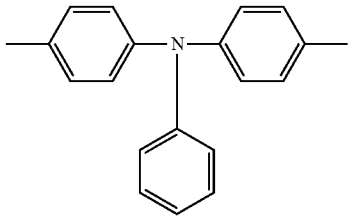 | 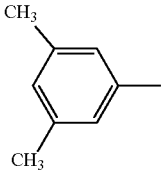 | H | 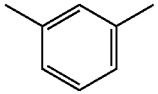 | H | H |
| 9A | 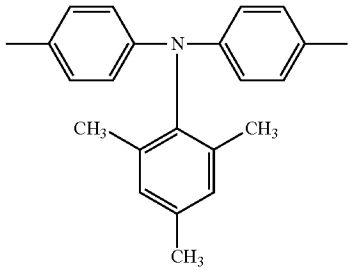 | 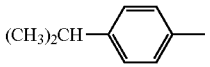 | H | 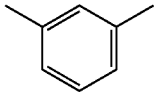 | H | H |

-continued
| Chemical structure No. | A | $Ar_1$ | $R_1$ | $Ar_2$ | $R_2$ | $R_3$ |
|---|---|---|---|---|---|---|
| 10A | 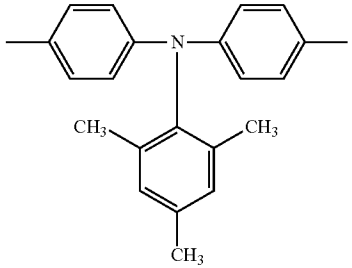 | 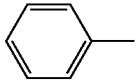 | H | 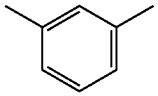 | H | 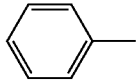 |
| 11A | 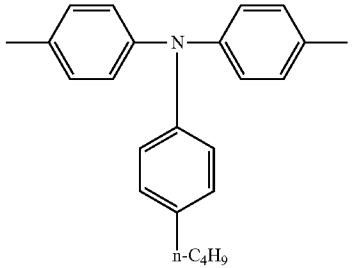 | 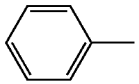 | 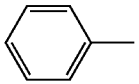 | 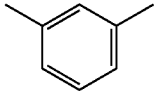 | H | H |
| 12A | 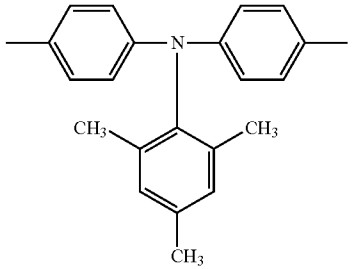 | 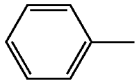 | 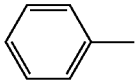 | 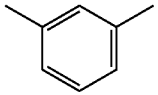 | H | H |

-continued
| Chemical structure No. | A | $Ar_1$ | $R_1$ | $Ar_2$ | $R_2$ | $R_3$ |
|---|---|---|---|---|---|---|
| 13A | 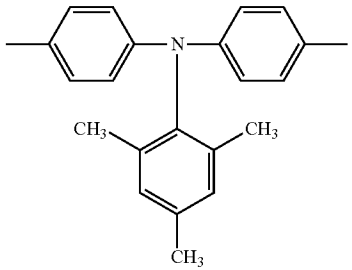 | 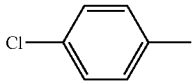 | 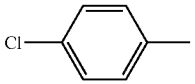 | 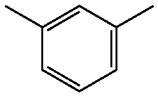 | H | H |
| 14A | 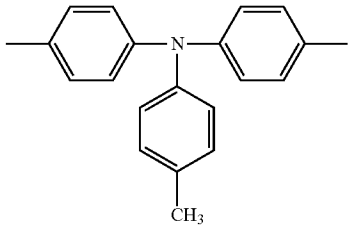 | 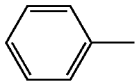 | H | 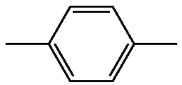 | H | H |
| 15A | 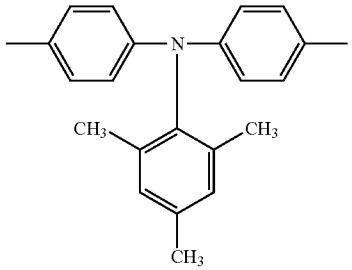 | 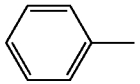 | H | 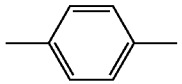 | H | H |

-continued
| Chemical structure No. | A | $Ar_1$ | $R_1$ | $Ar_2$ | $R_2$ | $R_3$ |
|---|---|---|---|---|---|---|
| 16A | 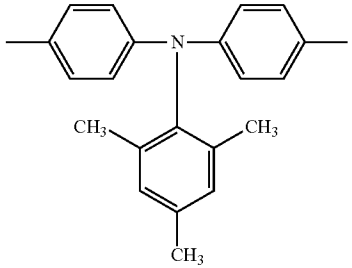 | 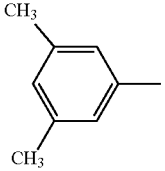 | H | 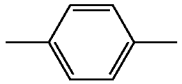 | H | H |
| 17A | 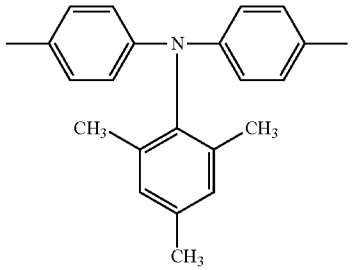 | 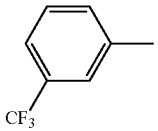 | H | 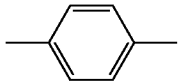 | H | H |
| 18A | 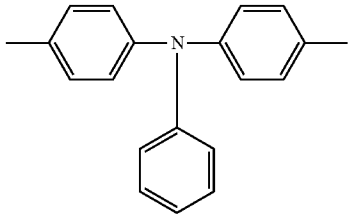 | 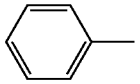 | 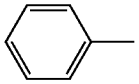 | 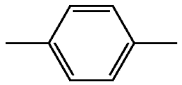 | H | H |
| 19A | 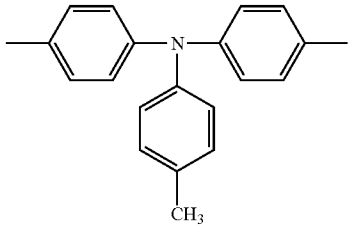 | 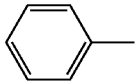 | 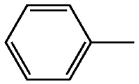 | 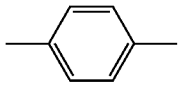 | H | H |

-continued
| Chemical structure No. | A | $Ar_1$ | $R_1$ | $Ar_2$ | $R_2$ | $R_3$ |
|---|---|---|---|---|---|---|
| 20A | 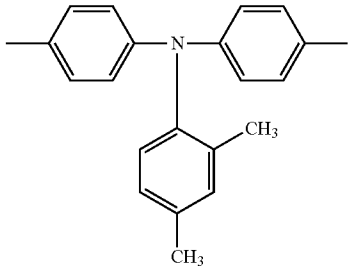 | 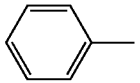 | 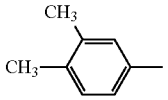 | 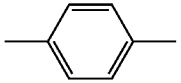 | H | H |
| 21A | 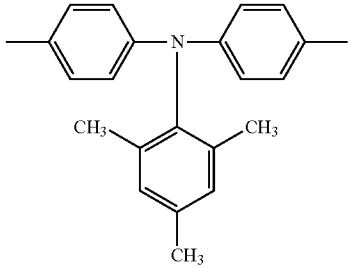 | 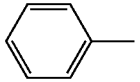 | 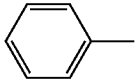 | 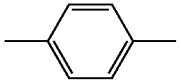 | H | H |
| 22A | 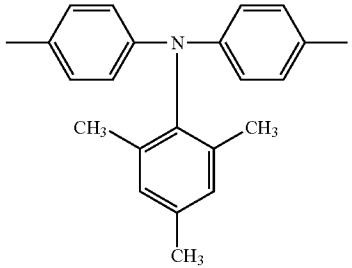 | 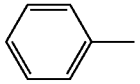 | 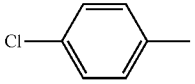 | 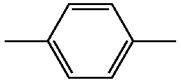 | H | H |

-continued
| Chemical structure No. | A | $Ar_1$ | $R_1$ | $Ar_2$ | $R_2$ | $R_3$ |
|---|---|---|---|---|---|---|
| 23A | 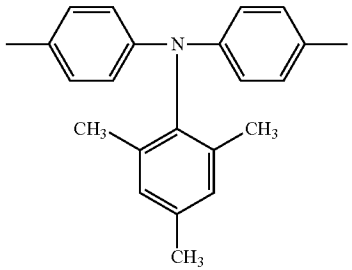 | 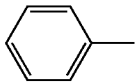 | 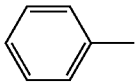 | 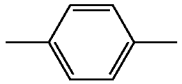 | H | 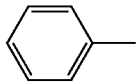 |
| 24A | 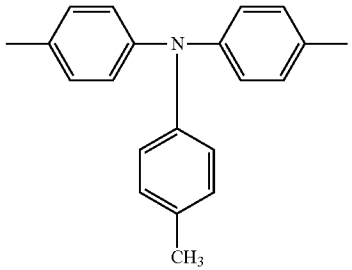 | 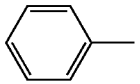 | 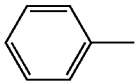 | 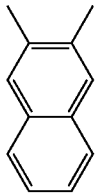 | H | H |
| 25A | 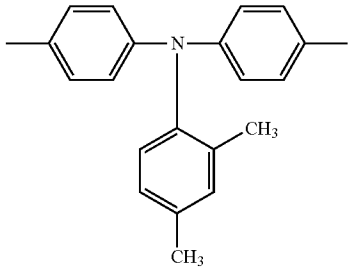 | 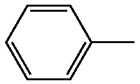 | 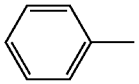 | 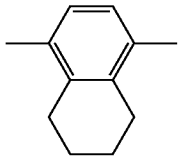 | H | H |

-continued
| Chemical structure No. | A | $Ar_1$ | $R_1$ | $Ar_2$ | $R_2$ | $R_3$ |
|---|---|---|---|---|---|---|
| 26A | 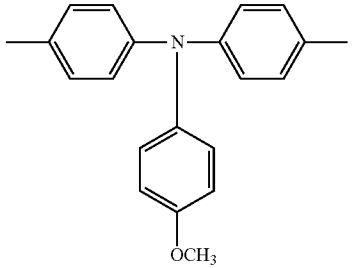 | 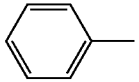 | 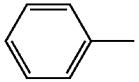 | 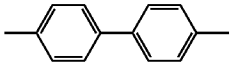 | H | H |
| 27A | 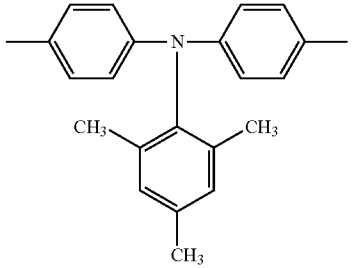 | 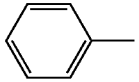 | 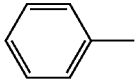 | 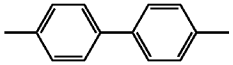 | H | 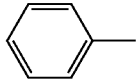 |
| 28A | 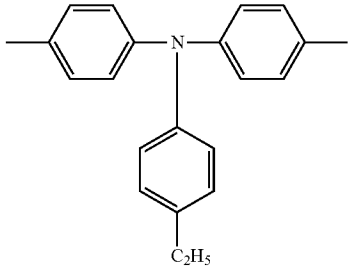 | 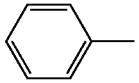 | 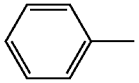 | 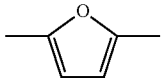 | H | H |

-continued
| Chemical structure No. | A | $Ar_1$ | $R_1$ | $Ar_2$ | $R_2$ | $R_3$ |
|---|---|---|---|---|---|---|
| 29A | 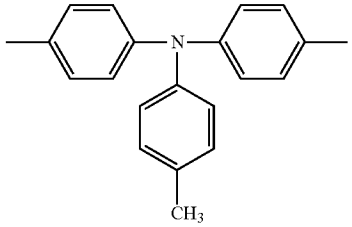 | 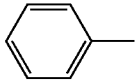 | 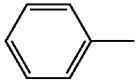 | 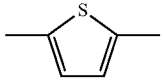 | H | H |
| 30A | 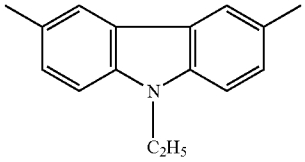 | 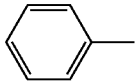 | H | 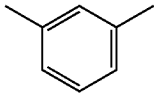 | H | H |
| 31A | 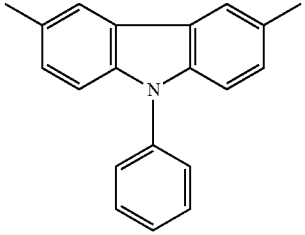 | 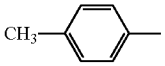 | H | 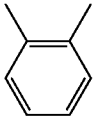 | H | H |
| 32A | 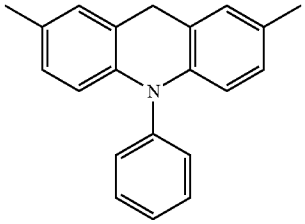 | 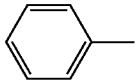 | 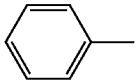 | 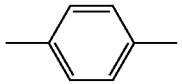 | H | H |

-continued
| Chemical structure No. | A | $Ar_1$ | $R_1$ | $Ar_2$ | $R_2$ | $R_3$ |
|---|---|---|---|---|---|---|
| 33A | 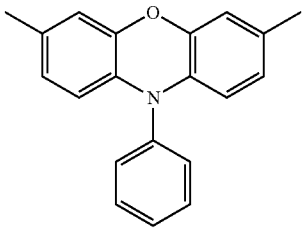 | 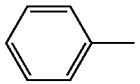 | 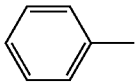 | 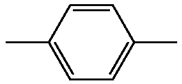 | H | H |
| 34A | 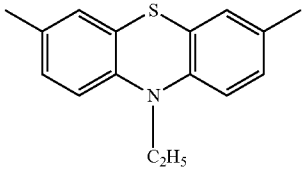 | 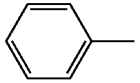 | 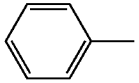 | 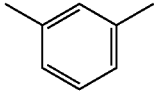 | H | H |
| 35A | 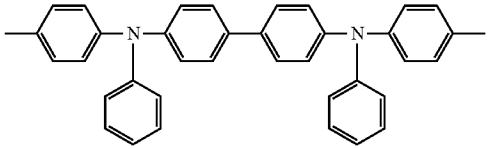 | 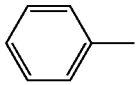 | 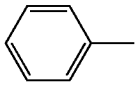 | 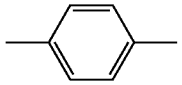 | H | H |
| 36A | 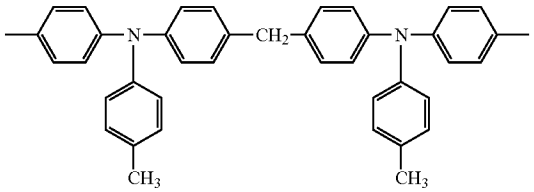 | 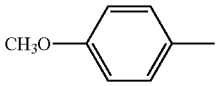 | H | 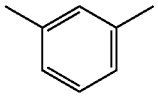 | H | H |

-continued
| Chemical structure No. | A | $Ar_1$ | $R_1$ | $Ar_2$ | $R_2$ | $R_3$ |
|---|---|---|---|---|---|---|
| 37A | 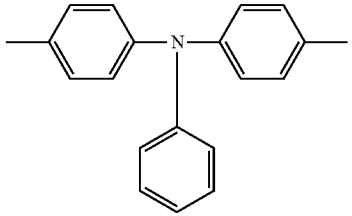 | 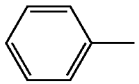 | H | 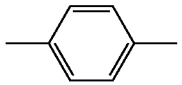 | $CH_3$— | H |
| 38A | 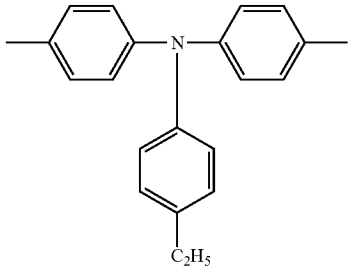 | 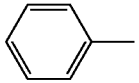 | 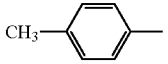 | 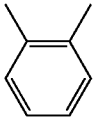 | 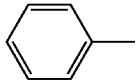 | H |
| 39A | 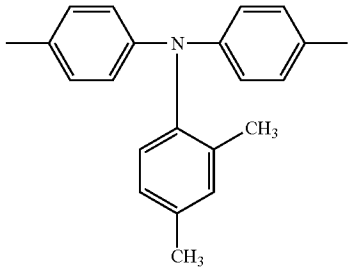 | 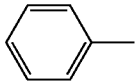 | 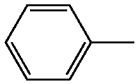 | 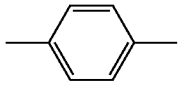 | 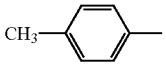 | H |

-continued
| Chemical structure No. | A | $Ar_1$ | $R_1$ | $Ar_2$ | $R_2$ | $R_3$ |
|---|---|---|---|---|---|---|
| 40A | 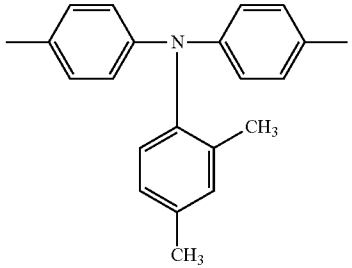 | 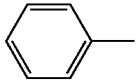 | 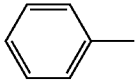 | 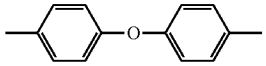 | H | H |
| 41A | 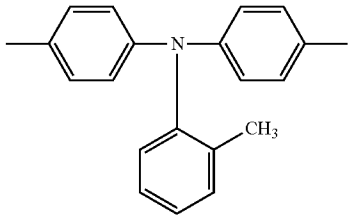 | 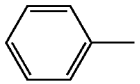 | 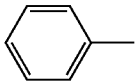 | 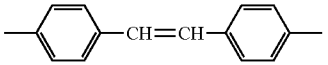 | H | H |
| 42A | 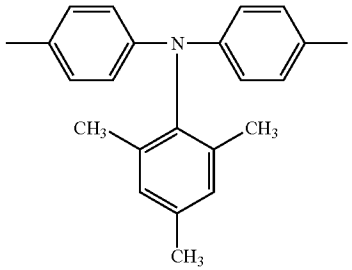 | 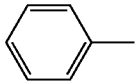 | 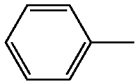 | 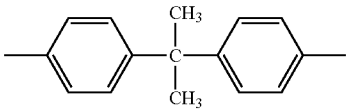 | H | H |

In the above exemplified compounds, $Ar_1$, $R_1$, $R_2$, and $R_3$ of Formula A are each the same, respectively. However, a compound having different $Ar_1$, $R_1$, $R_2$, and $R_3$ such as that represented by Formula A' is included in an example of the chemical structure of Formula 1.

CTM-group

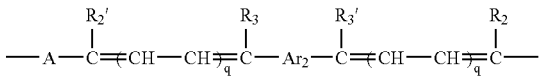

X

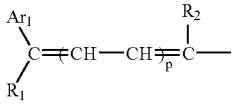

Y

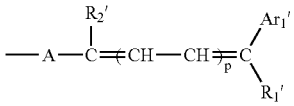

In Formula A', $Ar_1$ and $Ar_1'$ are each a substituted or unsubstituted mono-valent aromatic group; $Ar_2$ is a substituted or unsubstituted di-valent aromatic group or a group represented by Formula 2; $R_1$, $R_2$ and $R_3$, and $R_1'$, $R_2'$ and $R_3'$ are each a hydrogen atom, a substituted or unsubstituted alkyl group and a substituted or unsubstituted mono-valent aromatic group; and A is a divalent group having a trarylamino group or a group represented by Formula 3. $Ar_1$ and $R_1$, and $Ar_1'$ and $R_1'$, are each may be bonded to form a ring. P and q are each an integer of 0 or 1.

Chemical structures of typical compounds represented by Formula A' are shown below. The mixture compound represented by the above chemical structure is used as the charge transfer material, in which n has a range of distribution and (x+y) is not more than 99% when x represents the ratio of a component having the largest content and y represents the ratio of a component having the second content.

| Chemical structure No. | A | $Ar_1$ | $R_1$ | $Ar_1'$ | $R_1'$ | $Ar_2$ | $R_2$ | $R_2'$ | $R_3$ | $R_3'$ |
|---|---|---|---|---|---|---|---|---|---|---|
| 43A | 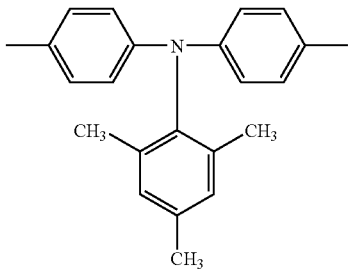 | 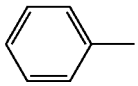 | 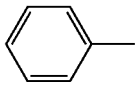 | 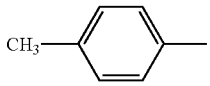 | 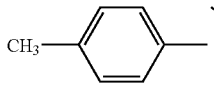 | 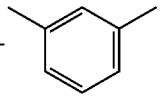 | H | H | H | H |
| 44A | 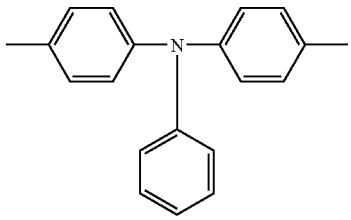 | 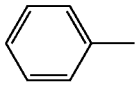 | 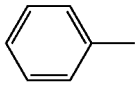 | 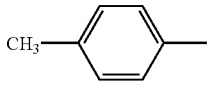 | 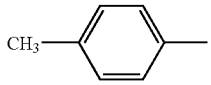 | 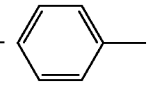 | H | H | H | 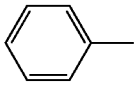 |

Synthesizing Examples of the compounds represented by Formula A are described below.

In the following synthesizing example, the raw materials are described by attaching the number shown in the scheme of the synthesis of the compound.

SYNTHESIZING EXAMPLE 1

Synthesis of Compound 21A (p=q=0)

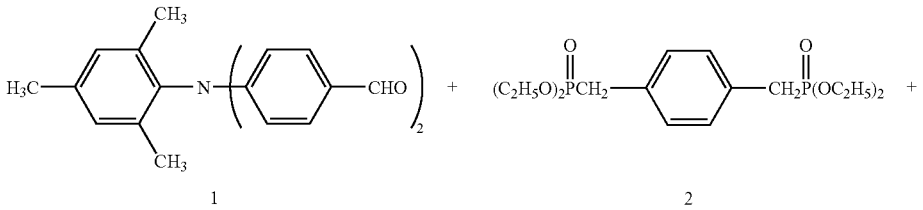

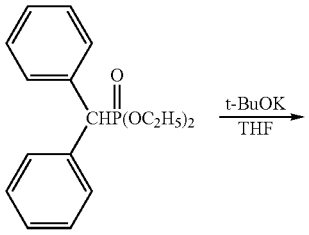

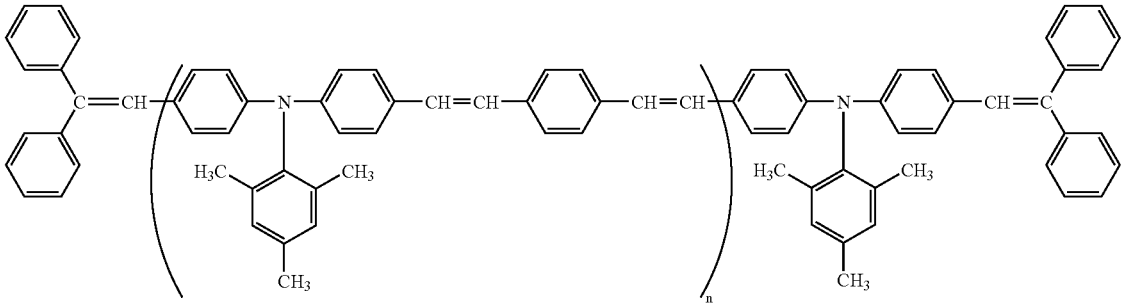

Into a 100 ml four-mouth flask to which a nitrogen gas introducing pipe, a cooler, a thermometer and a stirrer were equipped, 1.68 g (0.015 moles) of potassium tert-butoxide 4 and 20 ml of tetrahydrofuran, hereinafter referred to as THF, were charged and stirred while introducing nitrogen gas.

A solution was prepared by dissolving 2.06 g (0.006 moles) of Compound 1 and 1.13 g (0.003 moles) of Compound 2 and 1.92 g (0.0063 moles) of Compound 3 dissolved in 20 ml of THF. The solution was gradually dropped into the mixture of potassium tert-butoxide 4 and THF while the temperature was maintained at 45° C. After the finish of the dropping, reaction was carried out for 5 hours while maintaining a temperature of from 45° C. to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water in a ratio of 1:1 and dried for one night at a temperature of from 50° C. to 60° C. Thus unpurified crystals were obtained.

The unpurified crystals were dissolved in 30 ml of toluene, and 3 g of Wakogel B-0, produced by Wako Pure Chemical Industries, Ltd. was added to the solution and stirred for 30 minutes and filtered. The Wakogel. B-0 was washed by 30 ml of toluene. The filtrate and the washing toluene was concentrated and dried. The dried substance was dissolved by adding 10 ml of ethyl acetate. The solution was dropped into 60 ml of methanol for purifying by re-precipitation. By filtering and drying, 2.54 g of a compound having the chemical structure 21A (p=q=0) was obtained. As a result of analysis by high speed liquid chromatography and mass spectrography, the above-obtained compound is a mixture of compounds having n of from 0 to 4. The content ratio or area of high speed liquid chromatograph was n=0/1/2/3/4=25.4/48.8/18.1/6.3/1.4.

The conditions of the high speed liquid chromatography were as follows.

Measuring apparatus: Shimadzu LC6A, manufactured by Shimadzu Corporation.

Column: CLC-ODS, manufactured by Shimadzu Corporation.

Wavelength of detecting light: 290 nm

Moving phase: A mixture solvent of methanol and tetrahydrofuran in a ratio of 3:1.

Flowing velocity of moving phase: About 1 m/min.

The content ratio of the mixture compound is determined by the ratio of the area of each of the components in percent when the total content ratio was 100% after the separation by the high speed liquid chromatography. Among the above determining conditions, the determining apparatus, column and moving phase may be changed as long as the components of the mixture compound can be clearly separated and the results the same as the invention can be obtained.

SYNTHESIZING EXAMPLE 2

Synthesis of Compound 21A (p=1, and q=0)

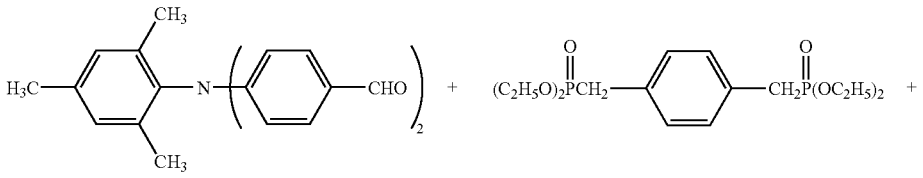

1 2

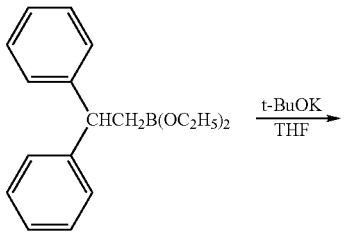

3 4

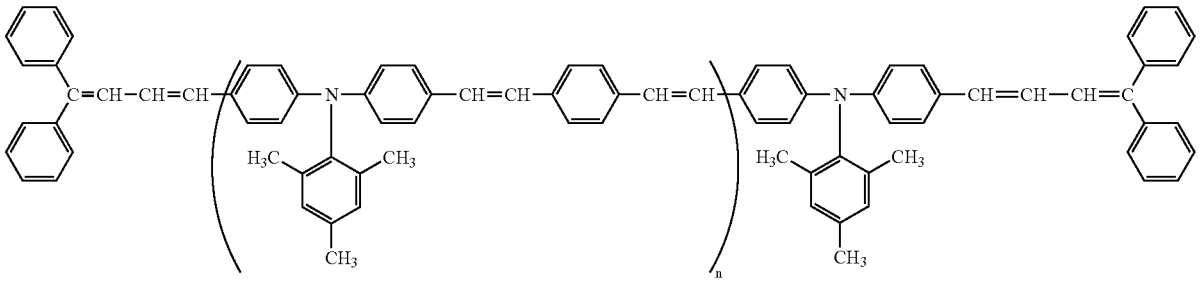

Into a 100 ml four-mouth flask to which a nitrogen gas introducing pipe, a cooler, a thermometer and a stirrer were equipped, 1.68 g (0.015 moles) of potassium tert-butoxide 4 and 20 ml of THF (tetrahydrofuran) were charged and stirred while introducing nitrogen gas.

A solution was prepared by dissolving 2.06 g (0.006 moles) of Compound 1 and 1.13 g (0.003 moles) of Compound 2 and 2.08 g (0.0063 moles) of Compound 3 dissolved in 20 ml of THF. The solution was gradually dropped into the mixture of potassium tert-butoxide 4 and THF while the temperature was maintained at 45° C. After the finish of the dropping, reaction was carried out for 5 hours while maintaining a temperature of from 45° C. to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water in a ratio of 1:1 and dried for one night at a temperature of from 50° C. to 60° C. Thus unpurified crystals were obtained.

The unpurified crystals were dissolved in 30 ml of toluene, and 3 g of Wakogel B-0, produced by Wako Pure Chemical Industries, Ltd. was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dropped into 60 ml of methanol for purifying by re-precipitation. By filtering and drying, 2.75 g of a Compound having the chemical structure 21A (p=1 and q=0) was obtained. As a result of analysis by high speed liquid chromatography and mass spectrography, the above-obtained compound is a mixture of compounds having n of from 0 to 4. The content ratio or area of high speed liquid chromatograph was n=0/1/2/3/4=33.4/46.8/15.0/4.0/0.8.

SYNTHESIZING EXAMPLE 3

Synthesis of Compound 14A (p=1 and q=0)

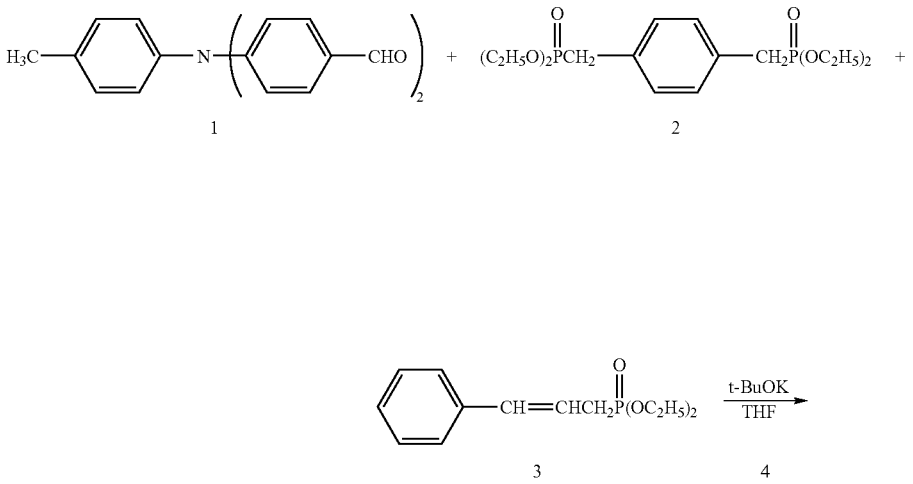

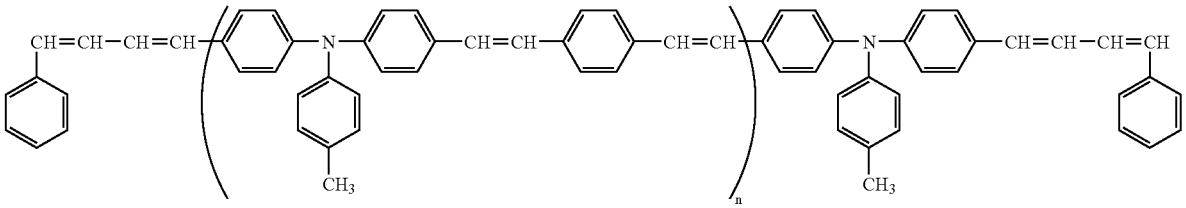

Into a 100 ml four-mouth flask to which a nitrogen gas introducing pipe, a cooler, a thermometer and a stirrer were equipped, 1.68 g (0.015 moles) of potassium tert-butoxide 4 and 20 ml of tetrahydrofuran, hereinafter referred to as THF, were charged and stirred while introducing nitrogen gas.

A solution was prepared by dissolving 1.89 g (0.006 moles) of Compound 1 and 1.13 g (0.003 moles) of Compound 2 and 1.60 g (0.0063 moles) of Compound 3 dissolved in 20 ml of THF. The solution was gradually dropped into the mixture of potassium tert-butoxide 4 and THF while the temperature was maintained at 45° C. After the finish of the dropping, reaction was carried out for 5 hours while maintaining a temperature of from 45° C. to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water in a ratio of 1:1 and dried for one night at a temperature of from 50° C. to 60° C. Thus unpurified crystals were obtained.

The unpurified crystals were dissolved in 30 ml of toluene, and 3 g of Wakogel B-0, produced by Wako Pure Chemical Industries, Ltd. was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dropped into 60 ml of methanol for purifying by re-precipitation. By filtering and drying, 2.32 g of a compound having the chemical structure 14A (p=1 and q=0) was obtained. As a result of analysis by high speed liquid chromatography and mass spectrography, the above-obtained compound is a mixture of compounds having n of from 0 to 4. The content ratio or area of high speed liquid chromatograph was n=0/1/2/3/4=30.1/45.4/16.7/6.0/1.8.

Concrete Examples of Formula B

| Chemical structure No. | A | $Ar_1$ | $Ar_2$ | $R_1$ | $R_2$ | $R_3$ |
|---|---|---|---|---|---|---|
| 1B | 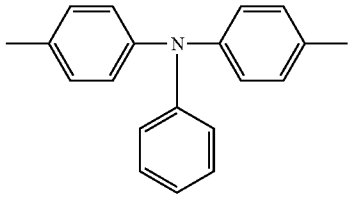 | 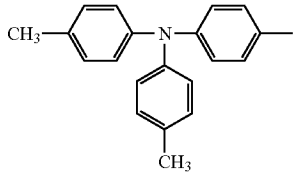 | 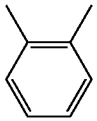 | H | H | H |
| 2B | 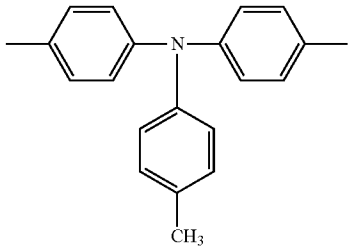 | 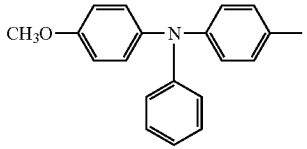 | 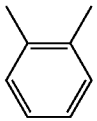 | H | H | H |
| 3B | 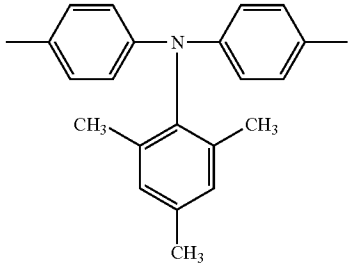 | 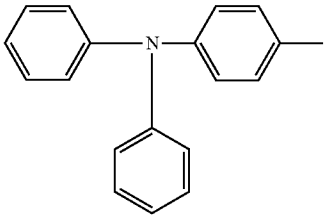 | 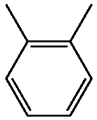 | H | H | H |
| 4B | 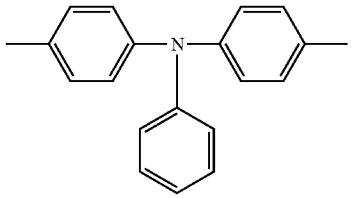 | 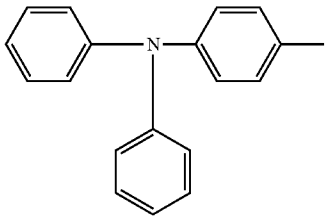 | 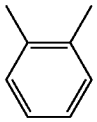 | H | 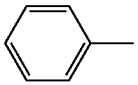 | H |

-continued
| Chemical structure No. | A | $Ar_1$ | $Ar_2$ | $R_1$ | $R_2$ | $R_3$ |
|---|---|---|---|---|---|---|
| 5B | 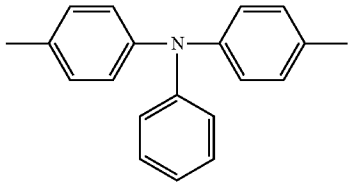 | 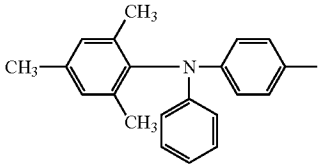 | 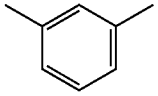 | H | H | H |
| 6B | 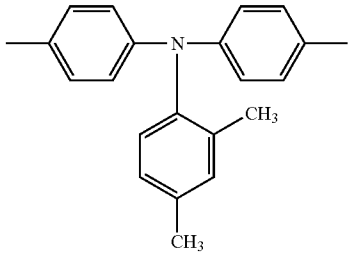 | 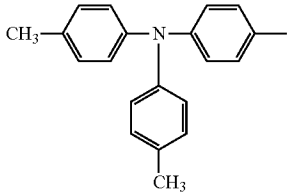 | 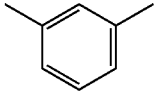 | H | H | H |
| 7B | 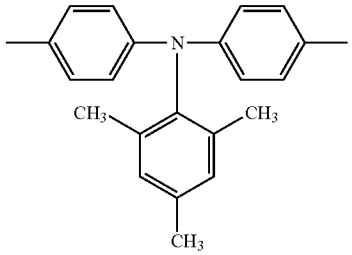 | 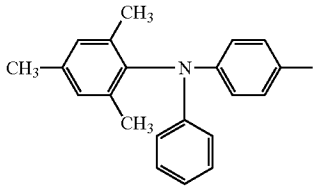 | 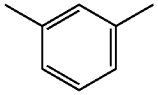 | H | H | H |
| 8B | 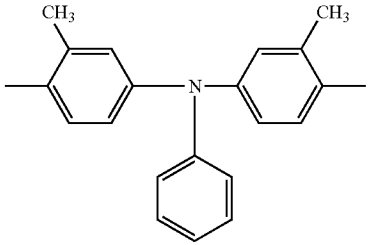 | 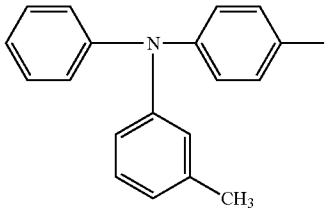 | 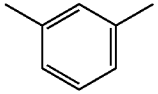 | H | 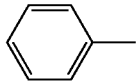 | H |

-continued
| Chemical structure No. | A | $Ar_1$ | $Ar_2$ | $R_1$ | $R_2$ | $R_3$ |
|---|---|---|---|---|---|---|
| 9B | 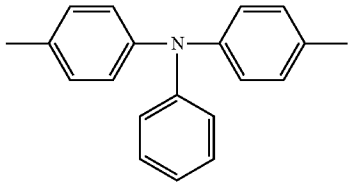 | 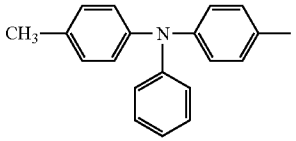 | 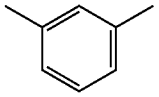 | H | H | H |
| 10B | 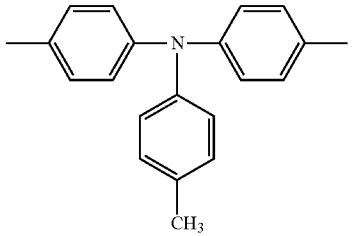 | 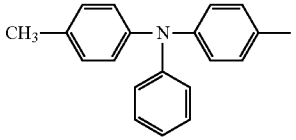 | 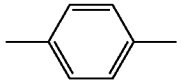 | H | H | H |
| 11B | 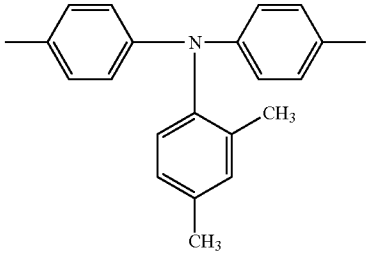 | 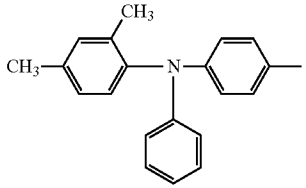 | 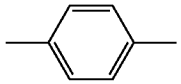 | H | H | H |
| 12B | 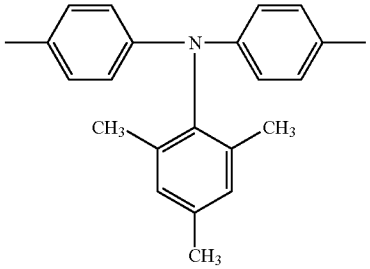 | 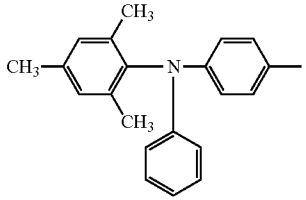 | 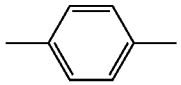 | H | H | H |

-continued
| Chemical structure No. | A | $Ar_1$ | $Ar_2$ | $R_1$ | $R_2$ | $R_3$ |
|---|---|---|---|---|---|---|
| 13B | 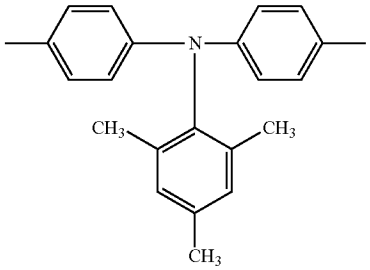 | 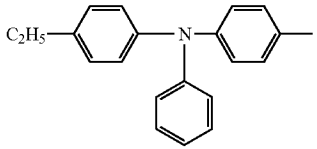 | 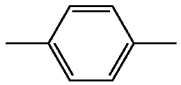 | H | H | H |
| 14B | 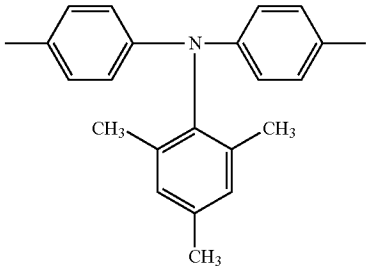 | 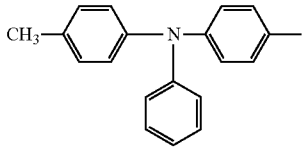 | 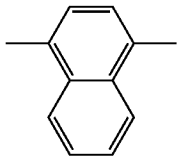 | H | H | H |
| 15B | 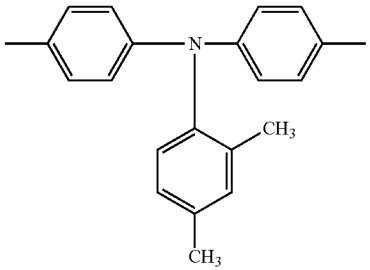 | 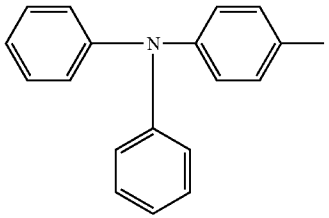 | 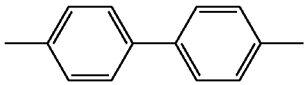 | H | H | H |

-continued
| Chemical structure No. | A | $Ar_1$ | $Ar_2$ | $R_1$ | $R_2$ | $R_3$ |
|---|---|---|---|---|---|---|
| 16B | 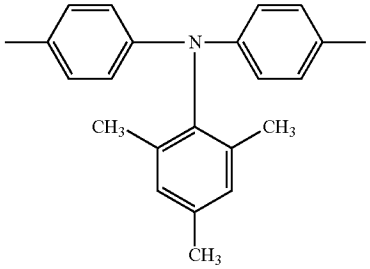 | 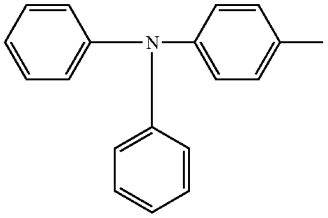 | 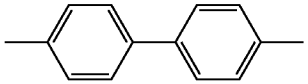 | H | H | H |
| 17B | 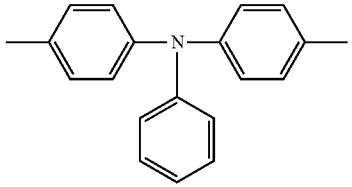 | 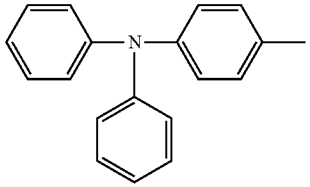 | 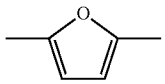 | H | H | H |
| 18B | 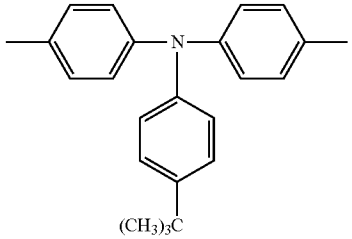 | 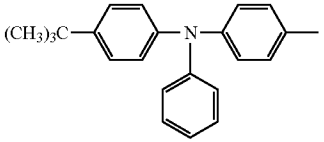 | 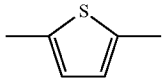 | H | H | H |
| 19B | 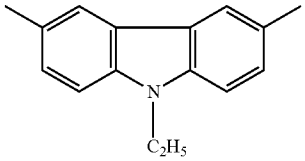 | 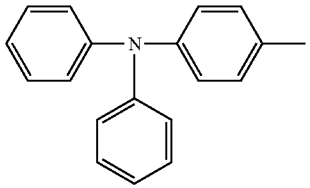 | 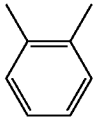 | H | H | H |

-continued
| Chemical structure No. | A | $Ar_1$ | $Ar_2$ | $R_1$ | $R_2$ | $R_3$ |
|---|---|---|---|---|---|---|
| 20B | 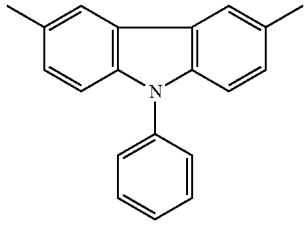 | 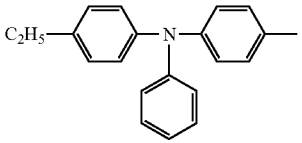 | 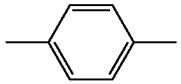 | H | H | H |
| 21B | 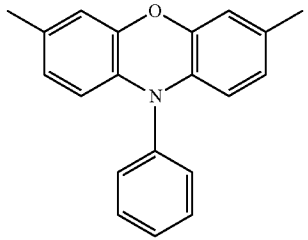 | 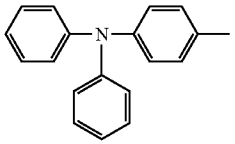 | 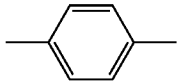 | H | H | H |
| 22B | 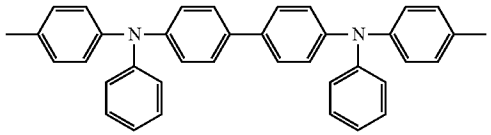 | 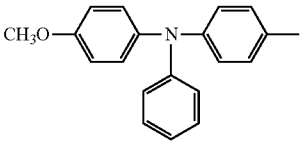 | 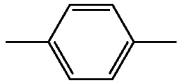 | H | H | H |
| 23B | 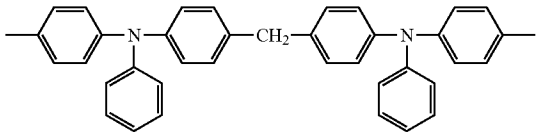 | 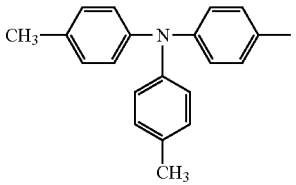 | 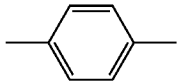 | H | H | H |

-continued
| Chemical structure No. | A | $Ar_1$ | $Ar_2$ | $R_1$ | $R_2$ | $R_3$ |
|---|---|---|---|---|---|---|
| 24B | 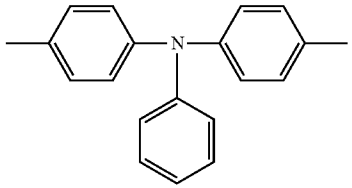 | 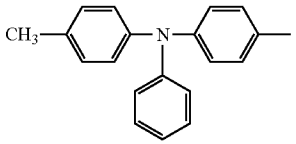 | 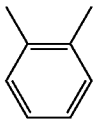 | H | H | $CH_3$— |
| 25B | 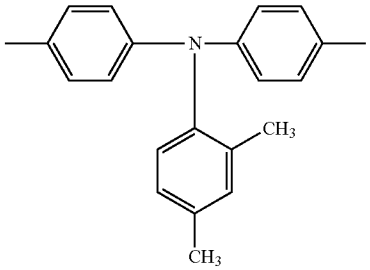 | 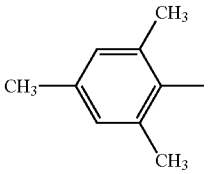 | 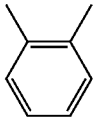 | H | H | H |
| 26B | 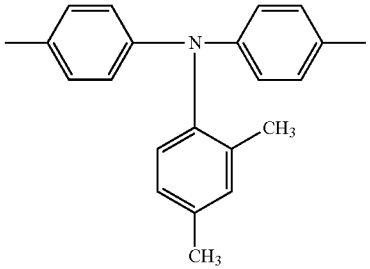 | 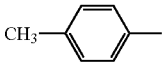 | 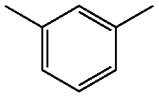 | 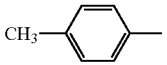 | H | H |
| 27B | 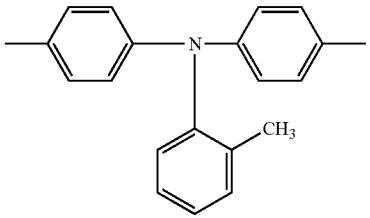 | 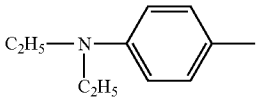 | 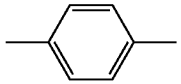 | H | H | H |

-continued
| Chemical structure No. | A | $Ar_1$ | $Ar_2$ | $R_1$ | $R_2$ | $R_3$ |
|---|---|---|---|---|---|---|
| 28B | 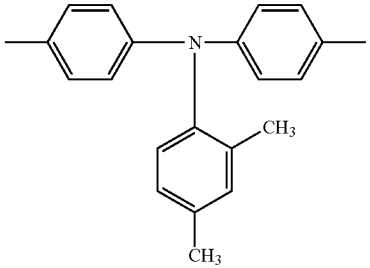 | 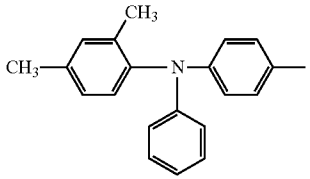 | 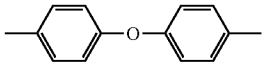 | H | H | H |
| 29B | 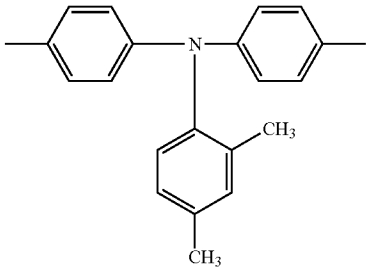 | 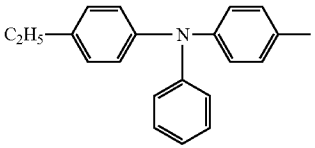 | 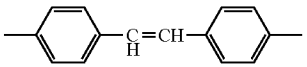 | H | H | H |
| 30B | 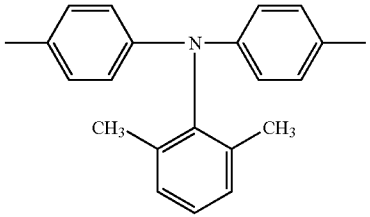 | 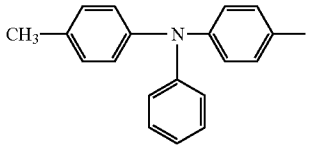 | 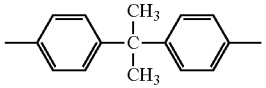 | H | H | H |

The above-described exemplified compounds are examples of the compound in which plural B, $R_1$, $R_2$ and $R_3$ in Formula B are each the same. However, compounds in which plural B, $R_1$, $R_2$ and $R_3$ are each different from the other are included. For example, the following compounds represented by Formula B' are also included as the compound represented by Formula B.

Formula B'

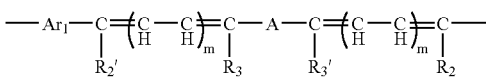

CTM-group

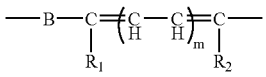

X

-continued

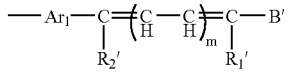

Y

In Formula B', $Ar_1$ is a substituted or unsubstituted divalent aromatic group, a furan group or a thiophene; $R_1$, $R_2$ and $R_3$, and $R_1'$, $R_2'$ and $R_3'$ are each a hydrogen atom, a substituted or unsubstituted alkyl group and a substituted or unsubstituted mono-valent aromatic group; and A is a divalent group having a trarylamino group or a group represented by Formula 3. B and B' are each a substituted or unsubstituted aromatic group. m is each an integer of 0 or 1.

Chemical structure of the representative compound of the Formula B' is described below.

31B

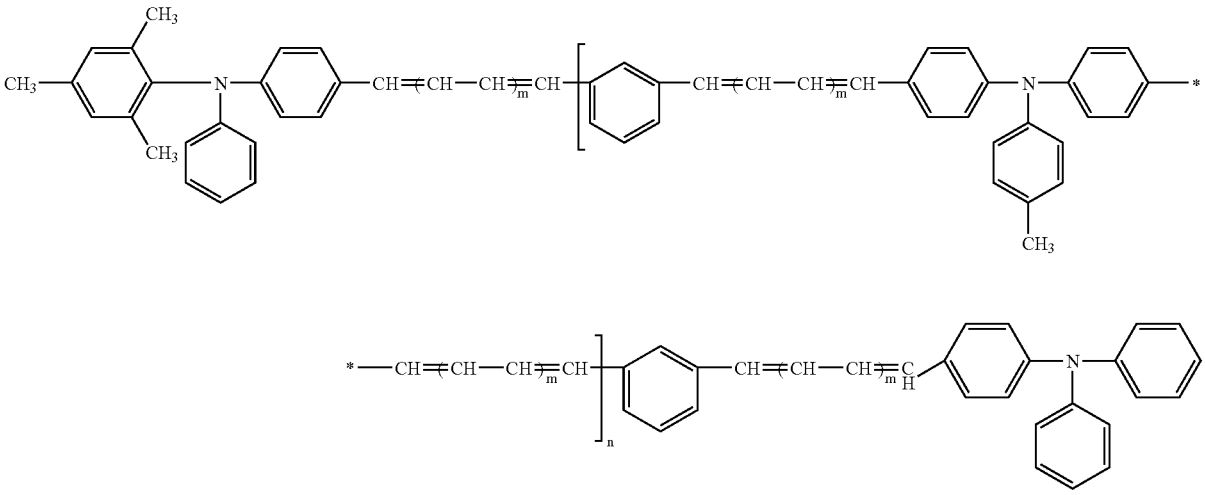

32B

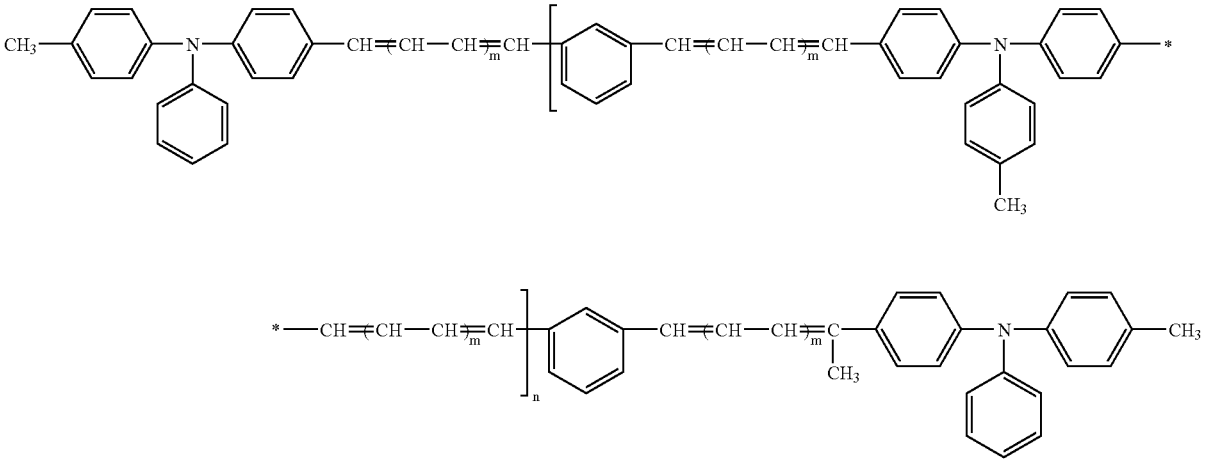

Synthesizing examples of compound represented by Formula B are shown below.

SYNTHESIZING EXAMPLE 4

Synthesis of Compound 12B (m=0)

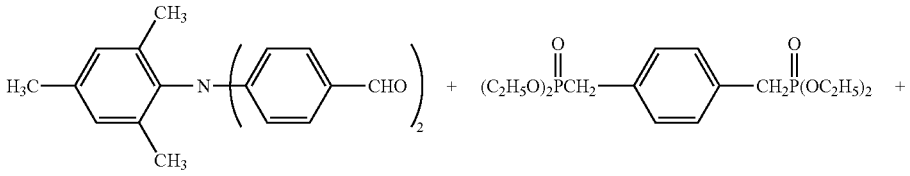

1 2

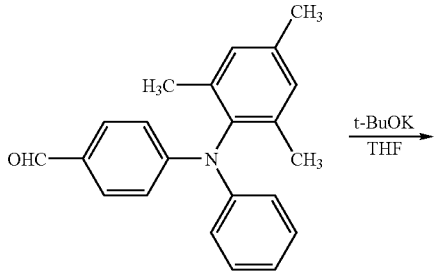

3 4

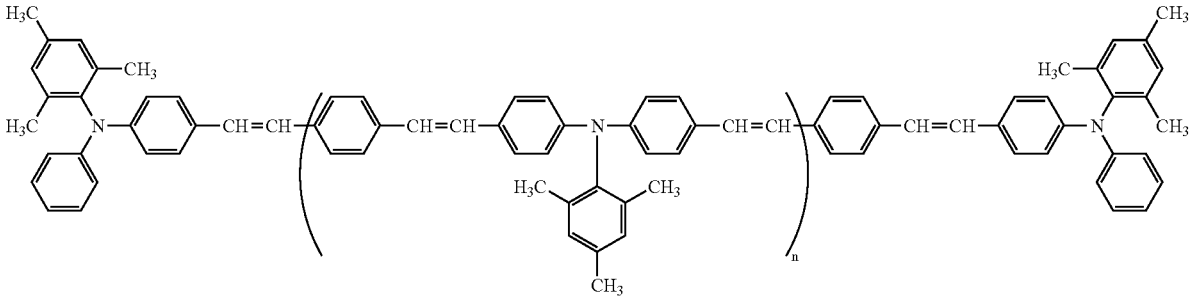

Into a 100 ml four-mouth flask to which a nitrogen gas introducing pipe, a cooler, a thermometer and a stirrer were equipped, 1.96 g (0.075 moles) of potassium tert-butoxide 4 and 20 ml of tetrahydrofuran, hereinafter referred to as THF, were charged and stirred while introducing nitrogen gas.

A solution was prepared by dissolving 1.0 g (0.003 moles) of Compound 1 and 2.63 g (0.007 moles) of Compound 2 and 2.25 g (0.008 moles) of Compound 3 dissolved in 20 ml of THF. The solution was gradually dropped into the mixture of potassium tert-butoxide 4 and THF while the temperature was maintained at 45° C. After the finish of the dropping, reaction was carried out for 5 hours while maintaining a temperature of from 45° C. to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water in a ratio of 1:1 and dried for one night at a temperature of from 50° C. to 60° C. Thus unpurified crystals were obtained.

The unpurified crystals were dissolved in 30 ml of toluene, and 3 g of Wakogel B-0, produced by Wako Pure Chemical Industries, Ltd., was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dropped into 60 ml of methanol for purifying by re-precipitation. By filtering and drying, 3.20 g of a compound having the chemical structure 12B (m=0) was obtained.

As a result of analysis by high speed liquid chromatography and mass spectrography in the same manner as in Synthesizing Example 1A, the above-obtained compound is a mixture of compounds having n of from 0 to 5. The content ratio or area of high speed liquid chromatograph was n=0/1/2/3/4/5=24.3/44.4/21.5/7.2/2.3/0.3.

The determination condition of the high speed chromatography was carried out under the following conditions.

SYNTHESIZING EXAMPLE 5

Synthesis of Compound 11B (m=0)

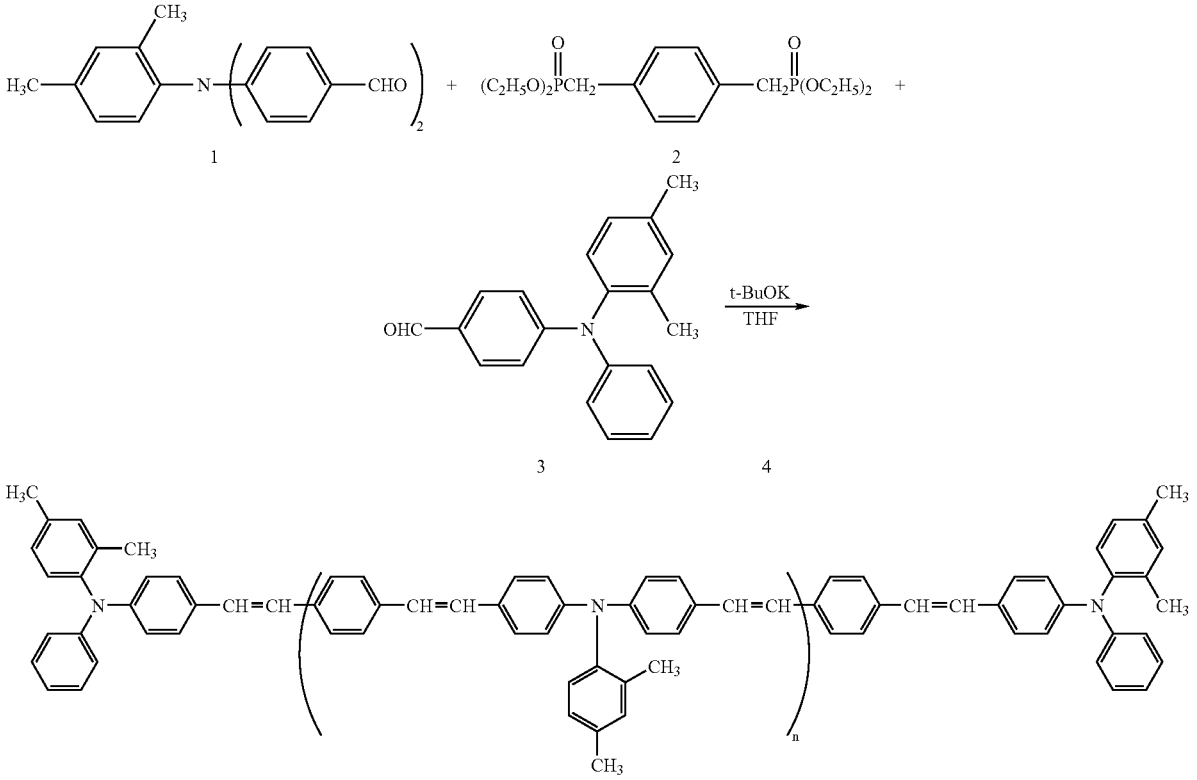

Into a 100 ml four-mouth flask to which a nitrogen gas introducing pipe, a cooler, a thermometer and a stirrer were equipped, 1.96 g (0.075 moles) of potassium tert-butoxide 4 and 20 ml of THF, were charged and stirred while introducing nitrogen gas.

A solution was prepared by dissolving 1.0 g (0.003 moles) of Compound 1 and 2.46 g (0.007 moles) of Compound 2 and 2.41 g (0.008 moles) of Compound 3 dissolved in 20 ml of THF. The solution was gradually dropped into the mixture of potassium tert-butoxide 4 and THF while the temperature was maintained at not higher than 45° C. After the finish of the dropping, reaction was carried out for 5 hours while maintaining a temperature of from 45° C. to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water in a ratio of 1:1 and dried for one night at a temperature of from 50° C. to 60° C. Thus unpurified crystals were obtained.

The unpurified crystals were dissolved in 30 ml of toluene, and 3 g of Wakogel B-0, produced by Wako Pure Chemical Industries, Ltd., was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dropped into 60 ml of methanol for purifying by re-precipitation. By filtering and drying, 3.35 g of a compound having the chemical structure 11B (m=0) was obtained.

As a result of analysis by high speed liquid chromatography and mass spectrography in the same manner as in Synthesizing Example 1A, the above-obtained compound is a mixture of compounds having n of from 0 to 4. The content ratio or area of high speed liquid chromatograph was n=0/1/2/3/4=32.5/45.0/16.5/6.2/1.6.

The compounds represented by Formula C each have the following chemical structure.

Formula C

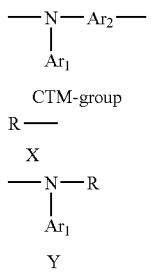

In Formula C, $Ar_1$ is a substituted or unsubstituted mono-valent aromatic group; $Ar_2$ is a substituted or unsubstituted di-valent aromatic group, a di-valent heterocyclic group, or a group represented by Formula 8; and R is a substituted or unsubstituted alkyl group or a substituted or unsubstituted mono-valent aromatic group. Plural $Ar_1$, $Ar_2$ and R are each different from each other.

Formula (8)

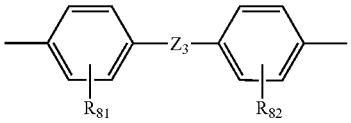

In Formula 8, $Z_3$ is an oxygen atom, a sulfur atom, a —CH═CH— group or a —$CH_2$—$CH_2$— group; and $R_{81}$ and $R_{82}$ are each a hydrogen atom or an alkyl group having from 1 to 4 carbon atoms.

In Formula C, $Ar_1$ is a substituted or unsubstituted monovalent aromatic group, and is preferably a substituted or unsubstituted phenyl group, a phenyl group substituted with an alkyl group having from 1 to 4 carbon atoms or an alkoxyl group.

As the substituted or unsubstituted divalent aromatic group represented by $Ar_2$ is preferably a phenylene group, a naphthylene group or a bi-phenylene group, and the substituent of them is preferably an alkyl group. As the di-valent heterocyclic group represented by $Ar_2$, a di-valent furan group and a di-valent thiophene group are preferable.

Concrete Examples of the Compound of Formula C

| Chemical structure No. | $Ar_1$ | $Ar_2$ | R |
|---|---|---|---|
| 1C | 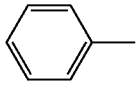 | 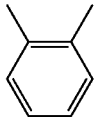 | 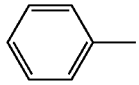 |
| 2C | 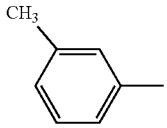 | 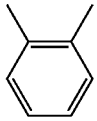 | 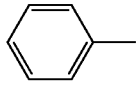 |
| 3C | 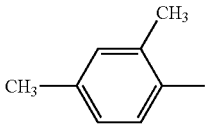 | 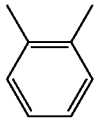 | 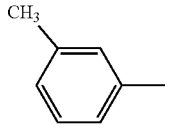 |
| 4C | 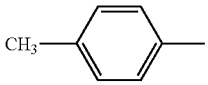 | 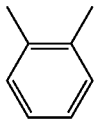 | $CH_3$ |
| 5C | 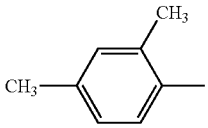 | 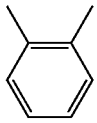 | 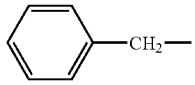 |
| 6C | 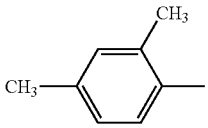 | 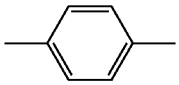 | 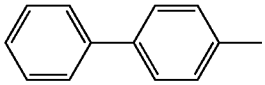 |
| 7C | 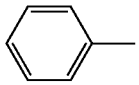 | 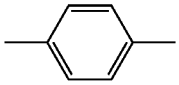 | 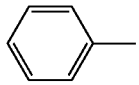 |
| 8C | 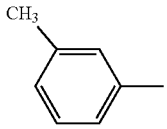 | 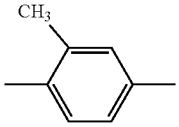 | 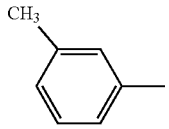 |

-continued
| Chemical structure No. | $Ar_1$ | $Ar_2$ | R |
|---|---|---|---|
| 9C | 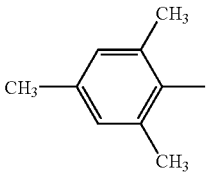 | 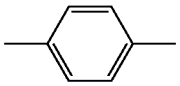 | 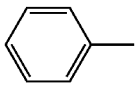 |
| 10C | 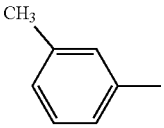 | 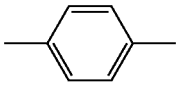 | 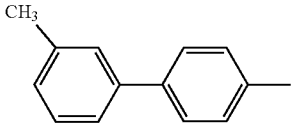 |
| 11C | 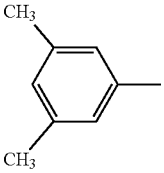 | 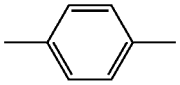 | $C_2H_5$— |
| 12C | 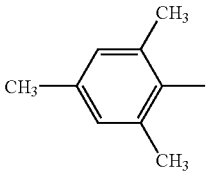 | 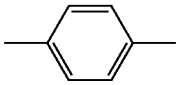 | 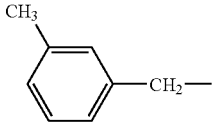 |
| 13C | 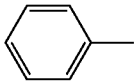 | 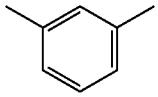 | 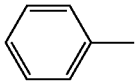 |
| 14C | 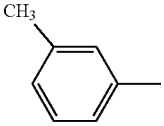 | 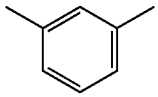 | 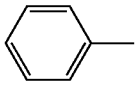 |
| 15C | 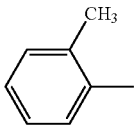 | 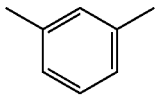 | 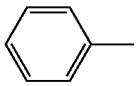 |
| 16C | 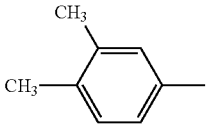 | 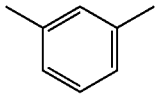 | 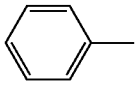 |
| 17C | 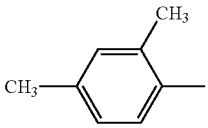 | 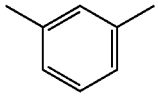 | 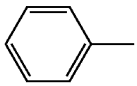 |
| 18C | 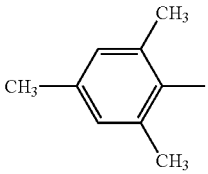 | 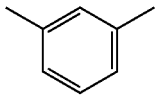 | 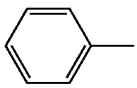 |

-continued
| Chemical structure No. | $Ar_1$ | $Ar_2$ | R |
|---|---|---|---|
| 19C | 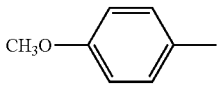 | 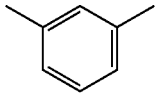 | 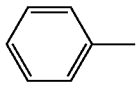 |
| 20C | 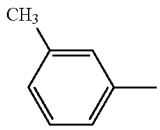 | 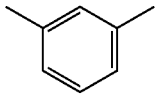 | 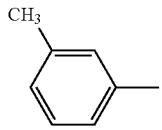 |
| 21C | 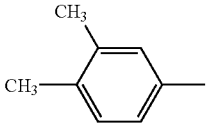 | 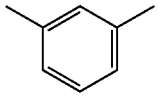 | 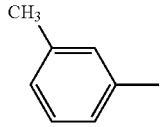 |
| 22C | 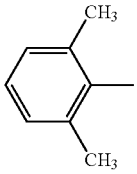 | 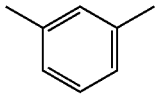 | 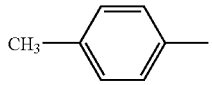 |
| 23C | 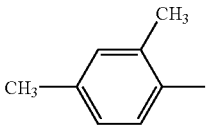 | 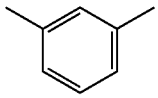 | 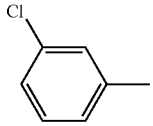 |
| 24C | 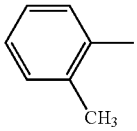 | 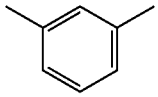 | 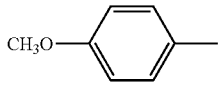 |
| 25C | 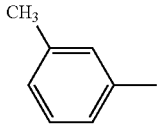 | 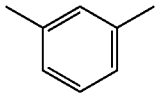 | 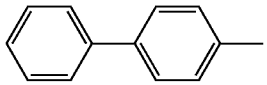 |
| 26C | 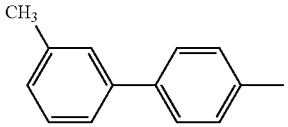 | 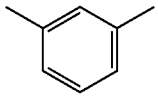 | 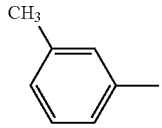 |
| 27C | 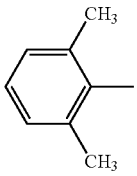 | 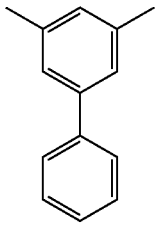 | 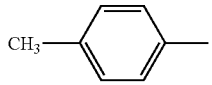 |

-continued
| Chemical structure No. | $Ar_1$ | $Ar_2$ | R |
|---|---|---|---|
| 28C | 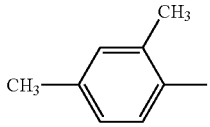 | 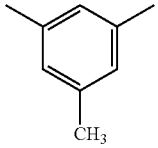 | 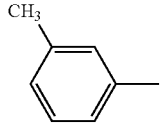 |
| 29C | 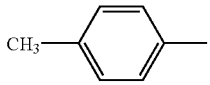 | 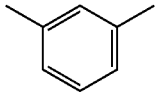 | $CH_3$— |
| 30C | 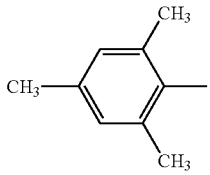 | 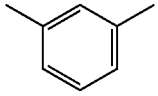 | 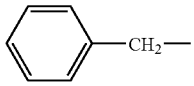 |
| 31C | 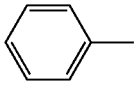 | 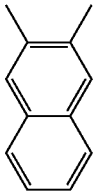 | 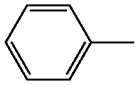 |
| 32C | 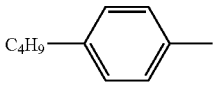 | 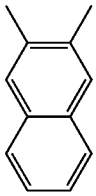 | 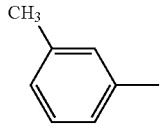 |
| 33C | 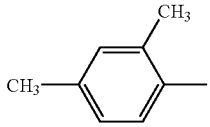 | 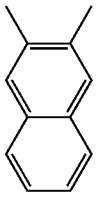 | $CH_3$— |
| 34C | 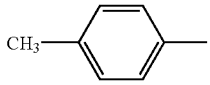 | 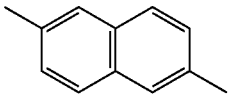 | 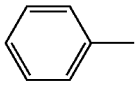 |
| 35C | 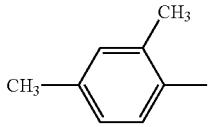 | 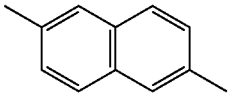 | 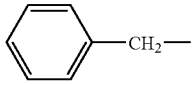 |
| 36C | 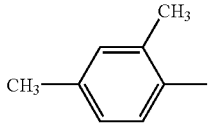 | 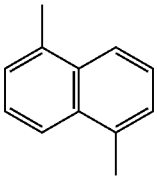 | 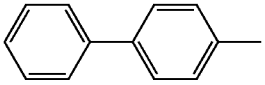 |

-continued
| Chemical structure No. | $Ar_1$ | $Ar_2$ | R |
|---|---|---|---|
| 37C | 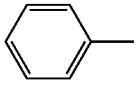 | 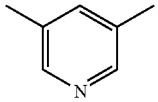 | 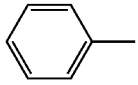 |
| 38C | 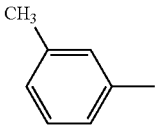 | 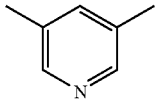 | 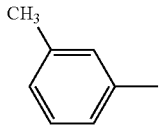 |
| 39C | 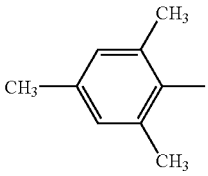 | 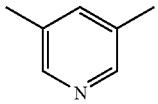 | 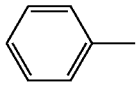 |
| 40C | 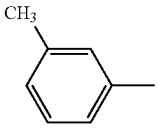 | 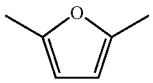 | 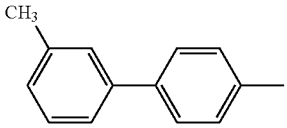 |
| 41C | 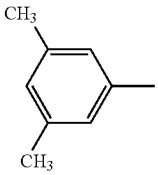 | 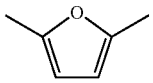 | $C_2H_5$— |
| 42C | 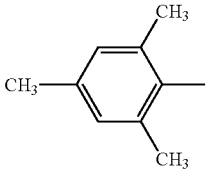 | 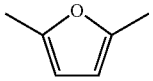 | 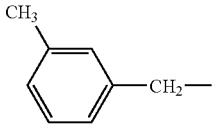 |
| 43C | 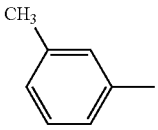 | 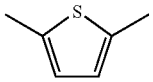 | 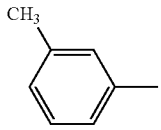 |
| 44C | 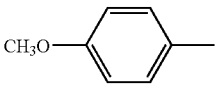 | 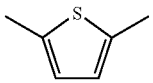 | 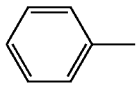 |
| 45C | 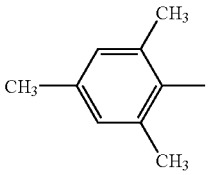 | 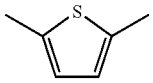 | 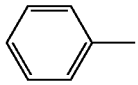 |
| 46C | 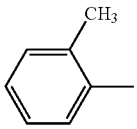 | 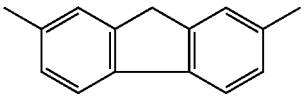 | 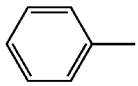 |

-continued
| Chemical structure No. | $Ar_1$ | $Ar_2$ | R |
|---|---|---|---|
| 47C | 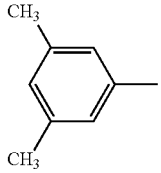 | 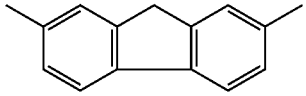 | 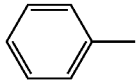 |
| 48C | 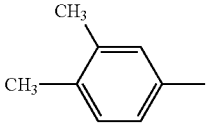 | 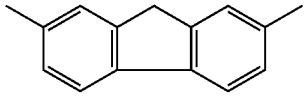 | 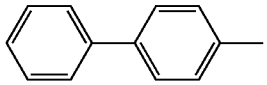 |
| 49C | 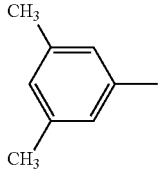 | 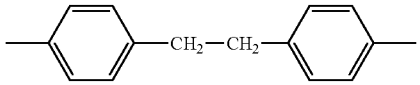 | 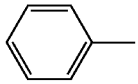 |
| 50C | 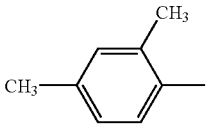 | 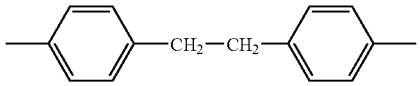 | 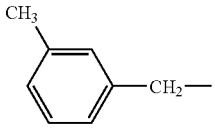 |
| 51C | 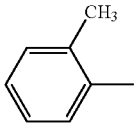 | 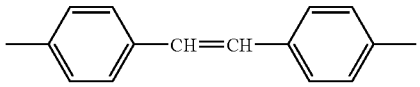 | 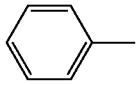 |
| 52C | 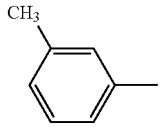 | 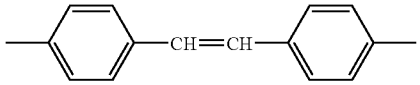 | 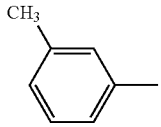 |
| 53C | 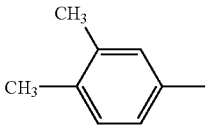 | 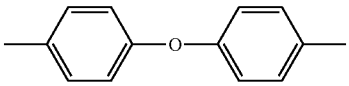 | 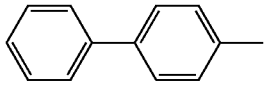 |
| 54C | 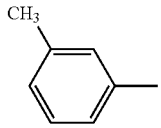 | 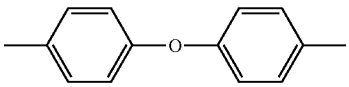 | 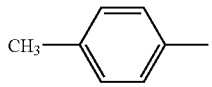 |
| 55C | 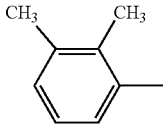 | 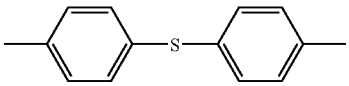 | 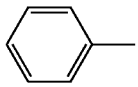 |
| 56C | 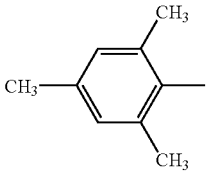 | 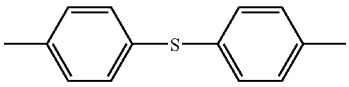 | $(CH_3)_3C$— |

The synthesizing example of compounds represented by Formula C is described below.

SYNTHESIZING EXAMPLE 6

Synthesize of Compound 17C

Into a 100 ml four-mouth flask to which a nitrogen gas introducing pipe, a cooler, a thermometer and a stirrer were equipped, 4.08 g (0.04 moles) of 2,4-dimethylaniline, 4.08 g (0.02 moles) of iodobenzene, 9.9 g (0.03 moles) of di-iodobenzene, 1.27 g (0.02 moles) of copper powder and 11.04 g (0.08 moles) of potassium carbonate were charged and reacted for 30 hours at 190° C. while introducing nitrogen gas.

The reacting liquid was cooled by 60° C. and 200 ml of THF was added to the liquid, and the mixture was filtered. The filtrate was concentrated and dissolved by 100 ml of toluene and 10 g of Wakogel B-0 (Wako Pure Chemical Industries, Ltd.) was added, and stirred for 30 minutes and filtered. Filtered Wakogel was washed by 30 ml of toluene. The filtrate and the washing liquid were concentrated and dried. The dried substance was dissolved by adding 20 ml of THF and the solution was dropped into 120 ml of methanol for purifying by re-precipitation. The precipitate was filtered and dried, thus 5.15 g of Compound 17C was obtained.

According to the results of the analysis by high speed liquid chromatography and mass spectrography, the above-obtained compound has a composition of n=0/1/2/3/4/5/6/7=2.7/9.0/24.3/34.2/20.1/7.8/1.7/0.2. The weight average molecular weight (in terms of polystyrene) Mw of the compound measured by gel permeation chromatography (GPC) was 910.

SYNTHESIZING EXAMPLE 7

Synthesis of Compound 48C

Into a 100 ml four-mouth flask to which a nitrogen gas introducing pipe, a cooler, a thermometer and a stirrer were equipped, 6.05 g (0.05 moles) of 2,4-dimethylaniline, 5.60 g (0.02 moles) of iodobiphenyl, 13.11 g (0.04 moles) of bis(4-bromophenyl)ether, 1.59 g (0.025 moles) of copper powder and 13.8 g (0.1 moles) of potassium carbonate were charged and reacted for 30 hours at 190° C. while introducing nitrogen gas.

The reacting liquid was cooled by 60° C. and 200 ml of THF was added to the liquid and the mixture was filtered. The filtrate was concentrated and dissolved by 100 ml of toluene and 10 g of Wakogel B-0 (Wako Pure Chemical Industries, Ltd.) was added, and stirred for 30 minutes and filtered. Filtered Wakogel was washed by 30 ml of toluene. The filtrate and the washing liquid were concentrated and dried. The dried substance was dissolved by adding 20 ml of THF, and the solution was dropped into 120 ml of methanol for purifying by re-precipitation. The precipitate was filtered and dried, thus 10.56 g of Compound 48C was obtained. According to the results of the analysis by high speed liquid chromatography and mass spectrography, the above-obtained compound has a composition of n=0/1/2/3/4/5/6/7/8=0.9/3.4/12.0/22.8/31.3/19.9/6.9/2.5/0.3. The weight average molecular weight (in terms of polystyrene) Mw of the compound measured by gel permeation chromatography (GPC) was 1684.

Photoreceptor

The components which may constitute electrophotographic photoreceptor including electroconductive substrate, an inter layer, a charge generation layer, and a charge transfer layer, as well as a conductive layer and a protective layer which are provided if necessary, are described. The photoreceptor preferably comprises a charge generation layer and a charge transfer layer provided on an electroconductive substrate.

Electroconductive Substrate

Both of a sheet-shaped substrate and a cylindrical substrate may be used as the electroconductive substrate of the photoreceptor. The cylindrical electroconductive substrate is preferred for designing a compact image forming apparatus.

The cylindrical electroconductive substrate is a cylinder-shaped substrate capable of endlessly forming an image, and such the substrate preferably has a linearity of not more than 0.1 mm and a fluctuation of not more than 0.1 mm.

A metal drum made from a metal such as aluminum and nickel, a plastic drum on which a conductive substance such as aluminum, tin oxide and indium oxide is evaporated and a paper or plastic drum on which an electroconductive material is coated, may be used as the electroconductive drum. The electroconductive substrate having a specific conductivity of not less than $10^3$ Ωcm is preferred.

An electroconductive substrate on which an anodized and sealed layer is provided may also be used. The anodizing treatment is usually performed in an acidic bath such as chromic acid, sulfuric acid, oxalic acid, phosphoric acid, boric acid and sulfamic acid, and the treatment by the sulfuric acid bath is preferable. In the case of the anodizing in the sulfuric acid bath, a sulfuric acid concentration of from 100 to 200 g/L, an aluminum ion concentration of from 1 to 10 g/L, a bath temperature of about 20° C. and an applying voltage of about 20 V are preferred. The average thickness of the anodized layer is usually not more than 20 μm, and preferably not more than 10 μm.

Interlayer

An interlayer (including a subbing layer) may be provided between the substrate and the photosensitive layer to improve the adhesiveness between the electroconductive substrate and the photosensitive layer and to prevent the injection of charge from the substrate. As the material of the interlayer, polyamide resin, vinyl chloride resin, vinyl acetate and copolymer containing at least two of the repeating unit of the above-mentioned resin are usable. Among the resins, polyamide resin is preferred since the remaining charge accompanied with the repeating use of the photoreceptor can be reduced by the use of polyamide resin. The thickness of the interlayer using such the resin is preferably from 0.01 to 0.8 μm.

An interlayer made from a hardenable metal resin is also preferred which is prepared by a thermally hardening of an organic metal compound such as a silane coupling agent and a titanium coupling agent. The thickness of the interlayer of hardenable metal resin is preferably from 0.1 to 2 μm.

An interlayer composed of a binder resin in which an organic particle is also preferably usable. The average diameter of the inorganic particles is preferably from 0.01 to 1 μm. An interlayer composed of a binder resin in which surface treated N-type semi-conductive fine particle is dispersed is particularly preferred. For example, an interlayer composed of polyamide resin and titanium oxide treated by silica.alumina compound and a silane having an average diameter of from 0.01 to 1 μm dispersed in the polyamide resin is particularly preferred. The thickness of such the interlayer is preferably from 1 to 20 μm.

Charge Generating Layer

Charge generation layer (CGL) contains a charge generation material (CGM). A binder resin and another additive may be contained according to necessity.

Examples of the CGM include a phthalocyanine dye, an azo dye, a perylene dye and an azurenium dye. Among them a CGM having a crystal structure capable of taking a stable aggregated structure among plural molecules thereof is most effective to inhibit the increasing of remaining potential accompanied with the repeating use. In concrete, CGM of a phthalocyanine dye and perylene dye each having a specific crystal structure are exemplified. For example, CGM of titanylphthalocyanine having the maximum peak of Bragg angle 2θ of diffraction of Cu-Kα X-ray at 27.2° and benzimidazoleperylene having the maximum peak of the 2θ angle at 12.4° show almost no degradation accompanied with the repeating use and show low remaining potential.

A resin can be used as the dispersing medium of the CGM in CGL. Examples of the most preferable resin include a formal resin, a butyral resin, a silicone resin, a silicone-modified butyral resin and a phenoxy resin. By the use of such the resins, the increasing of the remaining potential accompanied with the repeating use can be most inhibited. The ratio of the charge generation material to the binder resin is preferably from 20 to 600 parts by weight per 100 parts by weight of the binder resin. The thickness of the charge generation layer is preferably from 0.01 μm to 2 μm.

Charge Transfer Layer (CTL)

CTL contains the charge transfer material CTM and a binder resin for dispersing the CTM and for forming layer. An additive such as an antioxidant may be contained according to necessity.

As the CTM, a mixture of two or more kinds of compounds each represented by Formula 1, different from each other in n, is used. Moreover, for example, a triphenylamine derivative, a hydrazone compound, a styryl compound, a benzidine compound and a butadiene compound may be used with together. The charge transfer material is usually dissolved in the suitable resin for forming the layer. The thickness of the charge transfer layer is preferably from 10 μm to 40 μm.

Examples of resin to be used for CTL include a polystyrene resin, an acryl resin, a methacryl resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin and a copolymer containing two or more repeating units of the above-listed resins. Other than the forgoing insulation resin, an organic semi-conductive material such as poly-N-vinylacrbazole is usable.

Among them, polycarbonate resin is most preferable as the binder from the viewpoint of the dispersibility of the CTM and the electrophotographic properties. The ratio of the charge transfer material to the binder is preferably from 10 to 200 parts by weight per 100 parts by weight of the binder resin.

It is preferable that the CTL contains an antioxidant. The antioxidant prevents or inhibits the action caused by lighting, heating or discharging to an auto-oxidizable substance being at interior or surface of the photoreceptor. Various kind of antioxidants, for example, 2,6-di-t-butyl-4-methylphenol may be used.

Electro-Conductive Layer

The photoreceptor may have an electro-conductive layer on the substrate. The electro-conductive layer is fundamentally composed of a binder resin and an electro-conductive pigment. The thickness is preferably 0.3 to 10 μm, and more preferably 1 to 5 μm.

Protective Layer

The photoreceptor may have a protective layer, one of which is a durability improving layer on the CTL, the other example of which is a charge injection layer.

The durability improving layer is fundamentally composed of a resin and a CTM may be incorporated. The thickness is preferably 0.3 to 10 μm, and more preferably 1 to 5 μm.

The charge injection layer fundamentally composed of an electro-conductive fine particles and a binder resin. Examples of the binder resin may be those described as a binder for the CTL.

Examples of the electro-conductive fine particles include an anionic, cationic or nonionic organic electrolyte such as aliphatic acid salts, higher alcohols, sulfuric acid esters, aliphatic acid amines, quaternary ammoniums, alkylpyridiums, polyoxyethylenealkylethers, polyoxyethylenealkylesters, sorbitanalkylesters, and imidazolinederivatives; metal such as gold, silver, copper, nickel, and aluminum; metal oxide such as ZnO. $TiO_2$, $SnO_2$, $In_2O_3$, $SnO_2$ containing $Sb_2O_3$, and $SnO_2$ containing $In_2O_3$; a metal fluoride such as $MgF_2$, $CaF_2$, $BiF_2$, $AlF_2$, $SnF_2$, $SnF_4$ and $TiF_4$; an organic titanium compound such as tetraisopropyl titanate, tetranormalbutyl titanate, titanium acetyltitanate, and titanium lactate ethylester; and a mixture thereof.

The charge injection layer is provided so as to have a volume resistivity of $10^{10}$ to $10^{15}$ Ω·cm preferably and more preferably $10^{10}$ to $10^{14}$ Ω·cm. The more amount of the electro-conductive fine particle is incorporated, the lesser the strength is small in view of layer strength, and therefore, the amount is preferable to use as small as possible within the allowable range of resistivity of the charge injection layer and residual potential.

The preferable layer arrangement is described above, and the other layer arrangement other than mentioned above can be employed.

Examples of the solvent or the dispersing medium for forming the interlayer, charge generation layer, charge transfer layer, electroconductive layer, protective layer and so on include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2 dichloropropane, 1,1,2-trichloroethnae, 1,1,1-trichloroethane, trichloroethylene, tetrachloroethnae, tetrahydrofuran, dioxolane, dioxane, methanol, ethanol, butanol, isopropanol, ethyl acetate, butyl acetate, dimethylsulfoxide and methyl cellosolve. Dichloromethane, 1,2-dichloroethane and methyl ethyl ketone are preferably used. These solvents may be used solely or as a mixture of two or more kinds thereof.

The coating liquids for the layers are preferably filtered by a filter such as a metal filter and a membrane filter before the coating thereof for removing foreign matters or an aggregate. It is preferable that the filter is selected from filters such as a pleats type filter (HDC), a depth type filter (Profile), each distributed by Nihon Paul Corporation. and a semi-depth type filter (Profilestar) corresponding to the properties of the coating liquid.

A coating method such as an immersion coating method, a spray coating method and a circular coating amount controlling type coating are usable for producing the organic electrophotographic photoreceptor. The spray coating method or the coating method by a circular coating amount controlling coating type coater, typically a circular slide hopper coater, is preferably applied for coating the upper layer of the photosensitive layer since the dissolving of the lower layer can be inhibited as small as possible and the uniform coated layer can be formed by such the coating method. The circular coating amount controlling type coater is preferably applied for the coating of the protective layer. The circular coating amount controlling coater is detailed in, for example, JP O.P.I. Publication No. 58-189061.

The image forming method and the image forming apparatus using the photoreceptor are described below.

Particle Size Distribution

The toner preferable example of the toner is described.

The toner preferably has a number ratio of toner particles having a shape coefficient of 1.2 to 1.6 being at least 65 percent, a variation coefficient of the shape coefficient of 4 to 16 percent, and a number variation coefficient in the number particle size distribution of 8 to 27 percent. The shape coefficient shows a degree of roundness and is defined the following formula.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner particle on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient was obtained employing the aforementioned calculation formula.

The variation coefficient of the shape coefficient of the toner is calculated using the formula described below:

$$\text{Variation coefficient of the shape coefficient}=(S1/K)\times 100\ \text{(in percent)}$$

wherein S1 represents the standard deviation of the shape coefficient of 100 toner particles and K represents the average of said shape coefficient.

The variation coefficient of the shape coefficient is preferably 4 to 16%, and more preferably 6 to 14%.

The toner having the variation coefficient of the shape coefficient as above has sharp charge distribution and gives improved sharpness.

The number variation coefficient in the number particle distribution of toner is calculated employing the formula described below:

$$\text{Number variation coefficient}=(S/D_n)\times 100(\%)$$

wherein S represents the standard deviation in the number particle size distribution and $D_n$ represents the number average particle diameter (in μm).

The number variation coefficient in the number particle size distribution of toner is, preferably, 8 to 27 percent, and is more preferably 10 to 25 percent. By adjusting the number variation coefficient in the number particle size to the afore mentioned value, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency.

Methods to control the number variation coefficient in the number particle size are not particularly limited. For example, employed may be a method in which intermediate toner particles are classified employing forced air. However, in order to further decrease the number variation coefficient, classification in liquid is also effective. In said method, by which classification is carried out in a liquid, is one employing a centrifuge so that the intermediate toner particles are classified in accordance with differences in sedimentation velocity due to differences in the diameter of intermediate toner particles, while controlling the frequency of rotation.

The number particle distribution as well as the number variation coefficient of the toner is described. The number particle distribution and the number variation coefficient of the toner are measured employing a Coulter Counter TA-II or a Coulter Multisizer (both manufactured by Coulter Co.). Employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated.

The number particle distribution represents the relative frequency of toner particles with respect to the particle diameter, and the volume average particle diameter is a diameter at 50% accumulated volume of in the number particle size distribution, Dv 50.

The 50 percent volume particle diameter (Dv50), 50 percent number particle diameter (Dp50), cumulative 75 percent volume particle diameter (Dv75), and cumulative 75 percent number particle diameter (Dp75) may be determined by measurement with a Coulter Counter Type TAII or a Coulter Multisizer (both are manufactured by Coulter Inc.).

It is preferable that a ratio (Dv50/Dp50) is 1.0 to 1.15, and a ratio (Dv75/Dp75) is 1.0 to 1.20.

The volume average particle diameter of the toner particles Dv50 is preferably 3.0 to 8.0 μm, and more preferably 3.5 to 6.0 μm.

The toner having aforementioned particle size distribution characteristics can be employed by select and control the concentration of the coagulant (salting out agent), amount of the organic solvent, fusing period, composition of polymer and so on, and has high transfer efficiency whereby the image quality of half tone image, fine lines or dots is improved.

Preparation method of the toner is described.

Toner Preparation Method

The preparation method of toner is not particularly limited, and includes, for example, a pulverization method or a polymerization method. The toner prepared by a polymerization method is preferably employed.

The polymerization method includes such a process preparing fine resin particles by a suspension polymerization method, or an emulsion polymerization method or a mini-emulsion polymerization method, a process of adding required emulsifier in a certain step, and coagulation and fusing step of the fine resin particles by adding a coagulant such as an organic solvent or salts.

Suspension Polymerization

Added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus (stirring apparatus) which utilizes stirring blades and undergoes polymerization reaction upon heating. After completing the reaction, the dispersion stabilizers are removed, filtered, washed, and subsequently dried. In this manner, the toner can be prepared. The water based medium means one in which at least 50 percent, by weight of water, is incorporated.

Emulsion Polymerization

A method for preparing said toner may include one in which resin particles are associated, or fused, in a water based medium. For example, methods described in JP-A Nos. 5-265252, 6-329947, and 9-15904 is listed. It is possible to form the toner by employing a method in which at least two of the dispersion particles of components such as resin particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Preparation Method in Practice

The practical preparation method of polymerization method is described by referring examples.

Composite resin particles obtained by multi-step polymerization

An example of composite resin particles is described, in which an area other than the outermost layer of the composite resin particle contains a releasing agent.

The production process comprises mainly, for example, the following processes:

1. A multi-step polymerizing process (I) to obtain a composite resin which contains a releasing agent in an area other than the outermost layer, i.e., core area or inter layer.
2. A salting-out/coagulation process (II) to produce an intermediate toner particle by salting-out/coagulating the compound resin particles and colored particles.
3. Filtering and washing processes to filter the intermediate toner particles from the intermediate toner particle dispersion and to remove an unnecessary substance such as the surfactant from the intermediate toner particles.
4. A drying process to dry the washed intermediate toner particles.
5. A process to add an exterior additive to the intermediate toner particles.

Each of the processes is described more in detail below.

Multi-Step Polymerization Process (I)

The multi-step polymerization process (I) is a process for preparing the composite resin particle having covering layer of polymer on a resin particle.

It is preferred from the viewpoint of the stability and the anti-crush strength of the obtained toner to apply the multi-step polymerization including three or more polymerization steps.

The two- and tree-step polymerization methods, which are representative examples, are described below.

Two-Step Polymerization Method

The two-step polymerization method is a method for producing the composite resin particle comprised of the central portion (core) containing the crystalline material comprising the high molecular weight resin and an outer layer (shell) comprising the low molecular weight resin.

Practically a monomer liquid is prepared by incorporating a releasing agent in a monomer K, the monomer liquid is dispersed in an aqueous medium, such as an aqueous solution of a surfactant, in a form of oil drop, and the system is subjected to a polymerization treatment (the first polymerization step) to prepare a dispersion of a higher molecular weight resin particles each containing the releasing agent.

Next, a polymerization initiator and a monomer K to form the lower molecular weight resin is added to the suspension of the resin articles, and the monomer K is subjected to a polymerization treatment (the second polymerization step) to form a covering layer composed of the lower molecular weight resin (a polymer of the monomer K) onto the resin particle.

Three-Step Polymerization Method

The three-step polymerization method is a method for producing the composite resin particle comprised of the central portion (core) comprising the high molecular weight resin, the inter layer containing the crystalline material and the outer layer (shell) comprising the low molecular weight resin.

Practically a suspension of the resin particles prepared by the polymerization process (the first polymerization step) according to a usual procedure is added to an aqueous medium (an aqueous solution of a surfactant), and a monomer liquid prepared by incorporating the releasing agent in a monomer M is dispersed in the aqueous medium. The aqueous dispersion system is subjected to a polymerization treatment (the second polymerization step) to form a covering layer (inter layer) comprising a resin (a polymer of the monomer M) containing the crystalline material onto the surface of the resin particle (core particle). Thus a suspension of combined resin (higher molecular weight resin-middle molecular weight resin) particles is prepared.

Next, a polymerization initiator and a monomer K to form the lower molecular weight resin is added to the dispersion of the combined resin particles, and the monomer is subjected to a polymerization treatment (the third polymerization step) to form a covering layer composed of the low molecular weight resin (a polymer of the monomer K) onto the composite resin particle.

In the three-step polymerization method, the releasing agent can be finely and uniformly dispersed by applying a procedure, at the time of forming the inter layer on the resin particle.

The polymer is preferably obtained by polymerization in the aqueous medium. The releasing agent is incorporated in a monomer, and the obtained monomer liquid is dispersed in the aqueous medium as oil drop at the time of forming resin particles (core) or covering layer thereon (inter layer) containing the releasing agent, and resin particles can be obtained as latex particles by polymerization treatment with the addition of initiator.

The water based medium means one in which from 50 to 100 percent by weight of water, is incorporated. Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like, which do not dissolve resins.

In the usual emulsion polymerization method, the releasing agent dissolved in oil phase tends to dissolve. On the other hand sufficient amount of the releasing agent can be incorporated in a resin particle or covered layer by the mini-emulsion method.

Herein, homogenizers to conduct oil droplet dispersion, employing mechanical forces include, for example, CLEARMIX (by M-Technique), ultrasonic homogenizers, mechanical homogenizers, and Manton-Gaulin homogenizers and pressure type homogenizers. The diameter of dispersed particles is 10 to 1,000 nm, and is preferably 30 to 300 nm.

Herein, homogenizers to conduct oil droplet dispersion, employing mechanical forces, are not particularly limited, and include, for example, CLEARMIX, ultrasonic homogenizers, mechanical homogenizers, and Manton-Gaulin homogenizers and pressure type homogenizers. The diameter of dispersed particles is 10 to 1,000 nm, and is preferably 30 to 300 nm.

Methods such as an emulsion polymerization, suspension polymerization and seed emulsion may be employed as the polymerization method to form resin particles or covered layer containing the releasing agent. These polymerization methods are also applied to forming resin particles (core particles) or covered layer which do not contain the releasing agent.

The particle diameter of composite particles obtained by the process (1) is preferably from 10 to 1,000 nm in terms of weight average diameter determined employing an electrophoresis light scattering photometer ELS-800 (produced by OTSUKA ELECTRONICS CO., LTD.).

Glass transition temperature (Tg) of the composite resin particles is preferably from 48 to 74° C., and more preferably from 52 to 64° C.

The Softening point of the composite resin particles is preferably from 95 to 140° C.

Salting-Out/Fusion Process (II)

Salting-out/fusion process (II) is a process to obtain intermediate toner particles having undefined shape (aspherical shape) in which the composite resin particles obtained by the foregoing multi-step polymerization process (I) and colored particles are aggregated.

Salting-out/fusion process is that the processes of salting-out (coagulation of fine particles) and fusion (distinction of surface between the fine particles) occur simultaneously, or the processes of salting-out and fusion are induced simultaneously. Particles, composite resin particles and colored particles, are subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. Surface of the colored particles may be modified by a surface modifier.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, CLEARMIX, ultrasonic homogenizers, mechanical homogenizers, and Manton-Gaulin homogenizers and pressure type homogenizers.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

Filtration and Washing Process

In the filtration and washing process, filtration is carried out in which said intermediate toner particles are collected from the intermediate toner particle dispersion, and washing is also carried out in which additives such as surface active agents, salting-out agents, and the like, are removed from the collected intermediate toner particles (a cake-like aggregate).

Herein, filtering methods include a centrifugal separation method, a vacuum filtration method which is carried out employing Buchner funnel and the like, a filtration method which is carried out employing a filter press, and the like.

Drying Process

The washed intermediate toner particles are dried in this process.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried intermediate toner particles is preferably not more than 5 percent by weight, and is more preferably not more than 2 percent by weight.

Further, when dried intermediate toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner is preferably produced by the following procedure, in which the compound resin particle is formed in the presence of no colorant, a dispersion of the colored particles is added to the dispersion of the compound resin particles and the compound resin particles and the colored particles are salted-out and coagulated. Thus, the polymerization reaction is not inhibited since the preparation of the compound resin particle is performed in the system without colorant.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

Each of the constituting materials used in the toner producing process is described in detail below.

Polymerizable Monomer

A hydrophobic monomer is essentially used as the polymerizable monomer for producing the resin or binder and a cross-linkable monomer is used according to necessity. As is described below, it is preferable to contain at least one kind of a monomer having an acidic polar group and a monomer having a basic polar group.

Hydrophobic Monomer

The hydrophobic monomer can be employed. One or more kinds of which may be used for satisfying required properties.

Practically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrne, 3,4-dichlorostyrene, and the like.

Listed as (meth)acrylic acid and its ester bases monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

Monomer Having an Acidic Polar Group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its Na salt, allylsulfo succinic acid, allylsulfo succinic acid octyl ester and their sodium salts.

Monomer Having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrylamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

Polymerization Initiators

Radical polymerization initiators may be suitably, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (for example, ascorbic acid), which is capable of initiating the polymerization at room temperature, it is possible to carry out polymerization at room temperature or higher.

Chain Transfer Agents

For the purpose of regulating the molecular weight of resin particles, it is possible to employ commonly used chain transfer agents.

The chain transfer agents include mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservation ability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapto group, a neopentyl glycol compound having mercapto group, and a pentaerythritol compound having mercapto group. Among them n-octyl-3-mercaptopropionic acid ester is preferable in view of minimizing smell at the time of thermal fixing.

Surface Active Agents

In order to perform polymerization employing the aforementioned radical polymerizable monomers, it is required to conduct oil droplet dispersion in a water based medium employing surface active agents. Surface active agents, which are employed for said dispersion include ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-(-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

These surfactants are mainly used as the emulsifying aids during emulsion polymerization, and may be used for other purpose in the other process.

Molecular weight Distribution of Resin Particle or Toner

The toner particles has a peak or a shoulder within the range of from 100,000 to 1,000,000, and a peak or a shoulder within the range of from 1,000 to 50,000, and more preferably a peak or a shoulder within the range of from 100,000 to 1,000,000, from 25,000 to 150,000 and from 1,000 to 50,000, in the molecular weight distribution.

The resin particles preferably comprises a high molecular weight resin component having a peak or a shoulder within the range of from 100,000 to 1,000,000, and a low molecular weight resin component having a peak or a shoulder within the range of from 1,000 to 50,000, and more preferably a middle molecular weight resin component having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 μM, the filtrate is injected in a GPC. Measurement conditions of GPC are described below. A column is stabilized at 40° C., and THF is flowed at a rate of 1 cc per minute. Then measurement is carried out by injecting approximately 100 μl of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko K.K., combinations of TSKgel G1000H, G2000H, G3000H, G4000H, G5000H, G6000H, G7000H, TSK guard column, produced by TOSO Corporation and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

Coagulants

The coagulants selected from metallic salts are preferably employed in the processes of salting-out, coagulation and fusion from the dispersion of resin particles prepared in t e aqueous medium.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration (coagulation point).

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ξ potential of the dispersion, and in addition the critical coagulation concentration may be obtained as the salt concentration which initiates a variation in the ξ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

Colorants

The toner can be obtained through by salting out/fusing the composite resin particles and colored particles. Listed as colorants which constitute the toner may be inorganic pigments, organic pigments, and dyes.

Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite can be incorporated when the toner is employed as a magnetic toner. In this instance from 20 to 60 weight percent of the magnetite is incorporated in view of sufficient magnetic characteristics.

Various organic pigments and dyes may be employed. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

The colorants may also be employed while subjected to surface modification. Examples of the surface modifying agents include silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "PLAINACT" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "PLAINACT AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

Releasing Agents

Toner is preferably prepared by fusing resin particles containing a releasing agent and colored particles in water based medium and then digesting the obtained particles whereby the releasing agent and the colorant are dispersed in resin matrix adequately to form a domain-matrix structure. The digestion is a process subjecting the fused particles to continuing agitation at a temperature of melting point of the releasing agent plus minus 20 centigrade.

Preferable examples of the releasing agent include low molecular weight polypropylene and low molecular weight polyethylene each having average molecular weight of 1,500 to 9,000, and a particularly preferable example is an ester compounds represented by General Formula (1), described below.

$$R^1—(OCO—R^2)_n \quad (1):$$

wherein n represents an integer of 1 to 4, and preferably 2 to 4, more preferably 3 or 4, and in particular preferably 4, $R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1) $CH_3-(CH_2)_{12}-COO-(CH_2)_{17}-CH_3$

2) $CH_3-(CH_2)_{18}-COO-(CH_2)_{17}-CH_3$

3) $CH_3-(CH_2)_{20}-COO-(CH_2)_{21}-CH_3$

4) $CH_3-(CH_2)_{14}-COO-(CH_2)_{19}-CH_3$

5) $CH_3-(CH_2)_{20}-COO-(CH_2)_6-O-CO-(CH_2)_{20}-CH_3$

6) $CH_3-(CH_2)_{20}-COO-(CH_2)_2-CH(CH_3)-CH_2-O-CO-(CH_2)_{20}-CH_3$

7) $CH_3-(CH_2)_{22}-COO-(CH_2)_2-CH(CH_3)-CH_2-O-CO-(CH_2)_{22}-CH_3$

8) $CH_3-(CH_2)_{22}-COO-CH_2-C(CH_3)_2-CH_2-O-CO-(CH_2)_{22}-CH_3$

9) $CH_3-(CH_2)_{26}-COO-CH_2-C(CH_3)_2-CH_2-O-CO-(CH_2)_{26}-CH_3$

10) $CH_2(O-CO-(CH_2)_{26}-CH_3)-CH(O-CO-(CH_2)_{26}-CH_3)-CH_2-O-CO-(CH_2)_{26}-CH_3$

11) $CH_2(O-CO-(CH_2)_{22}-CH_3)-CH(O-CO-(CH_2)_{22}-CH_3)-CH_2-O-CO-(CH_2)_{22}-CH_3$

12) $CH_2-OH-CH(O-CO-(CH_2)_{26}-CH_3)-CH_2-O-CO-(CH_2)_{26}-CH_3$

13) $CH_2-OH-CH(O-CO-(CH_2)_{22}-CH_3)-CH_2-O-CO-(CH_2)_{22}-CH_3$

14) $CH_2-OH-CH-OH-CH_2-O-CO-(CH_2)_{26}-CH_3$

15) $CH_2-OH-CH-OH-CH_2-O-CO-(CH_2)_{22}-CH_3$

-continued

16) $CH_3-(CH_2)_{26}-COO-CH_2-C(CH_3)(CH_2-O-CO-(CH_2)_{26}-CH_3)-CH_2-O-CO-(CH_2)_{26}-CH_3$

17) $CH_3-(CH_2)_{20}-COO-CH_2-C(CH_2CH_3)(CH_2-O-CO-(CH_2)_{20}-CH_3)-CH_2-O-CO-(CH_2)_{20}-CH_3$

18) $CH_3-(CH_2)_{26}-COO-CH_2-C(CH_2-O-CO-(CH_2)_{26}-CH_3)_2-CH_2-O-CO-(CH_2)_{26}-CH_3$

19) $CH_3-(CH_2)_{20}-COO-CH_2-C(CH_2-O-CO-(CH_2)_{20}-CH_3)_2-CH_2-O-CO-(CH_2)_{20}-CH_3$

20) $CH_3-(CH_2)_{18}-COO-CH_2-C(CH_2-O-CO-(CH_2)_{18}-CH_3)_2-CH_2-O-CO-(CH_2)_{18}-CH_3$

21) $CH_3-(CH_2)_{16}-COO-CH_2-C(CH_2-O-CO-(CH_2)_{16}-CH_3)_2-CH_2-O-CO-(CH_2)_{16}-CH_3$

22) $CH_3-(CH_2)_{20}-COO-CH_2-C(CH_2-O-CO-CH_3)_2-CH_2-O-CO-CH_3$

The releasing agent is added in an amount of between 2 and 20 percent by weight, and is preferably between 3 and 15 percent by weight.

The toner is preferably prepared by a way in which aforementioned releasing agent is incorporated within the resin particles by mini-emulsion method and then the resin particles are subjected to salting out/fusing with colorant particles.

Image Forming Apparatus and Image Forming Method

Heretofore, as a method in which an organic photoreceptor as an electrophotographic photoreceptor and a toner image formed on said organic photoreceptor is transferred onto a recording sheet for a final image, known is one to directly transfer a toner image having been formed on an organic photoreceptor onto a recording sheet. On the other hand, there is known an image forming method utilizing an intermediate transfer member, and this method is provided with one more transferring process in the transferring process of a toner image from an organic photoreceptor to a recording sheet so that a primary transferred image was secondarily transferred on an intermediate transfer member on to a recording sheet after transferring a toner image from an organic photoreceptor to an intermediate transfer member, resulting in formation of a final image. Among them, the above image forming method utilizing an intermediate transfer member is often employed as a cumulative transfer method of each color toner image in a so-called full-color image forming apparatus, in which an original image, having been subjected to color separation, is reproduced by means of subtractive mixture by use of such as black, cyan, magenta and yellow toners.

However, there caused new problems related to an intermediate transfer member in the above intermediate transfer method. One of the problems includes generation of uneven transfer or image defects such as so-called "hollow characters", in which a part of character image is lacking, due to variation of transfer or partial insufficient transfer in toner transfer onto an intermediate transfer member, which are caused by non-uniform pressing pressure at the contact interface between a photoreceptor and an intermediate transfer member, resulting in deterioration of sharpness.

When the transfer ability is lowered in the image forming process employing intermediate transfer member, so-called hollow characters and scattering characters, which is caused by that a part of toner is not transferred are sometimes observed.

The image forming method comprises charging a photoreceptor uniformly a photoreceptor, exposing the photoreceptor to form a latent image, developing the latent image by a developer containing a toner to form a toner image, transferring the toner image to an recording member, and fixing the toner image.

FIG. 1 is a cross-sectional constitution drawing of a color image forming apparatus showing an example.

The color image forming apparatus is called as a tandem type color image forming apparatus and is comprised of plural sets of color image forming portions 10Y, 10M, 10C and 10K; endless belt-form intermediate transfer member unit 7; paper supply and transport means 21; and fixing means 24. Original image reading device SC is mounted on the head of main body A of an image forming apparatus.

Image forming portion 10Y, at which an image of yellow color is formed, is comprised of electric charging means 2Y, exposure means 3Y, development means 4Y, primary transfer roller 5Y as a primary transfer means and cleaning means 6Y, which are arranged at the surroundings of drum-form photoreceptor 1Y as the first image carrier. Image forming portion 10M, at which an image of magenta color is formed, is comprised of drum-form photoreceptor 1M as the first image carrier, electric charging means 2M, exposure means 3M, development means 4M, primary transfer roller 5M as a primary transfer means and cleaning means 6M. Image forming portion 10C, at which an image of cyan color is formed, is comprised of drum-form photoreceptor 1C as the first image carrier, electric charging means 2C, exposure means 3C, development means 4C, primary transfer roller 5C as a primary transfer means and cleaning means 6C. Image forming portion 10K, at which an image of black color is formed, is comprised of drum-form photoreceptor 1K as the first image carrier, electric charging means 2K, exposure means 3K, development means 4K, primary transfer roller 5K as a primary transfer means and cleaning means 6K. The photoreceptor rotates with a line velocity, preferably, of 250 mm/sec or more on the photoreceptor surface.

Endless belt-form intermediate transfer member unit 7 is provided with endless belt-form transfer element 70 as a second image carrier of semi-conductive endless belt-shape which is wound and held rotatable around plural rollers.

Each color image formed at image forming portions 10Y, 10M, 10C and 10K is transferred successively onto rotating endless belt-form intermediate transfer member 70 to form a synthesized color image. Paper P as a recording material (a support carrying a fixed final image: for example, a plain paper, a transparent sheet, etc.) stored in paper supply cassette 20 is supplied through paper supply means 21 followed by being transported through plural intermediate rollers 22A, 22B, 22C and 22D and register roller 23 to secondary transfer roller SA as a secondary transfer means; and a color image is transferred collectively by a secondary transfer process on paper P. Paper P on which a color image has been transferred is subjected to a fixing treatment by fixing means 24, and is nipped by paper ejecting roller 25 to be placed on paper ejecting tray 26 outside of a machine.

On the other hand, endless belt-form intermediate transfer member 70, which is separated by curvature from paper P, is erased of a residual toner by cleaning means 6A after a color image is transferred onto paper P by secondary transfer roller 5A as a secondary transfer means.

During an image forming process, primary transfer roller 5K is always brought in pressing contact with photoreceptor 1K. Other primary transfer rollers 5Y, 5M and 5C are brought in pressing contact with corresponding photoreceptors 1Y, 1M and 1C respectively only when a color image is formed.

Secondary transfer roller 5A is pressing contacted with endless belt-form intermediate transfer member 70 only when a secondary transfer is performed by passing paper P therethrough.

Further, box element 8 is possible to be drawn out from apparatus main body A through support rails 82L and 82R.

Box element 8 is constituted of image forming portions 10Y, 10M, 10C and 10K, and endless belt-form intermediate transfer member 7.

Image forming portions 10Y, 10M, 10C and 10K are vertically arranged in a column. Endless belt-form intermediate transfer member 7 is arranged at the illustrated left side of photoreceptors 1Y, 1M, 1C and 1K. Endless belt-form transfer member unit 7 is constituted of endless belt-form transfer element 70 which is rotatable winding around rollers 71, 72, 73 and 74; primary transfer rollers 5Y, 5M, 5C and 5K; and cleaning means 6A.

Figure 2:
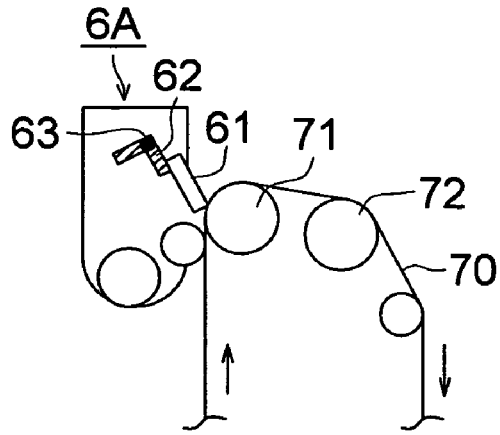
FIG. 2 shows an example of a cleaning device of an intermediate transfer member.

FIG. 2 shows an example of a cleaning means for an intermediate transfer member.

A cleaning means 6A for an intermediate transfer member is constituted of blade 61 attached to blanket 62 which is controlled so as to be rotatable around support shaft 63 as shown in FIG. 2, and is possible to adjust the blade pressing pressure against roller 71 by changing spring weight or loading weight.

Image forming portions 10Y, 10M, 10 C and 10K, together with endless belt-form intermediate transfer member 7, are drew out as one unit, from main body A by a drawing out operation of box element 8.

Support rail 82L on the illustrated left side of box element 8 is arranged on the left side of endless belt-form intermediate transfer member 70 and in the upper space portion of fixing means 24. Support rail 82R on the illustrated right side of box element 8 is arranged in the neighboring of under lowermost development means 4K. Support rail 82R is arranged at a position where the mounting and dismounting operations of development means 4Y, 4M, 4C and 4K on and from box element 8 is not interfered.

Photoreceptors 1Y, 1M, 1C and 1K in box element 8 are surrounded by development means 4Y, 4M, 4C and 4K at the illustrated right side, by such as electric charging means 2Y, 2M, 2C and 2K and cleaning means 6Y, 6M, 6C and 6K at the illustrated lower side, and by endless belt-form intermediate transfer member 70 at the illustrated left side.

Among them, such as a photoreceptor, a cleaning means and an electric charging means constitute one photoreceptor unit, and such as a development means and a toner supply device constitute one development unit.

Figure 3:
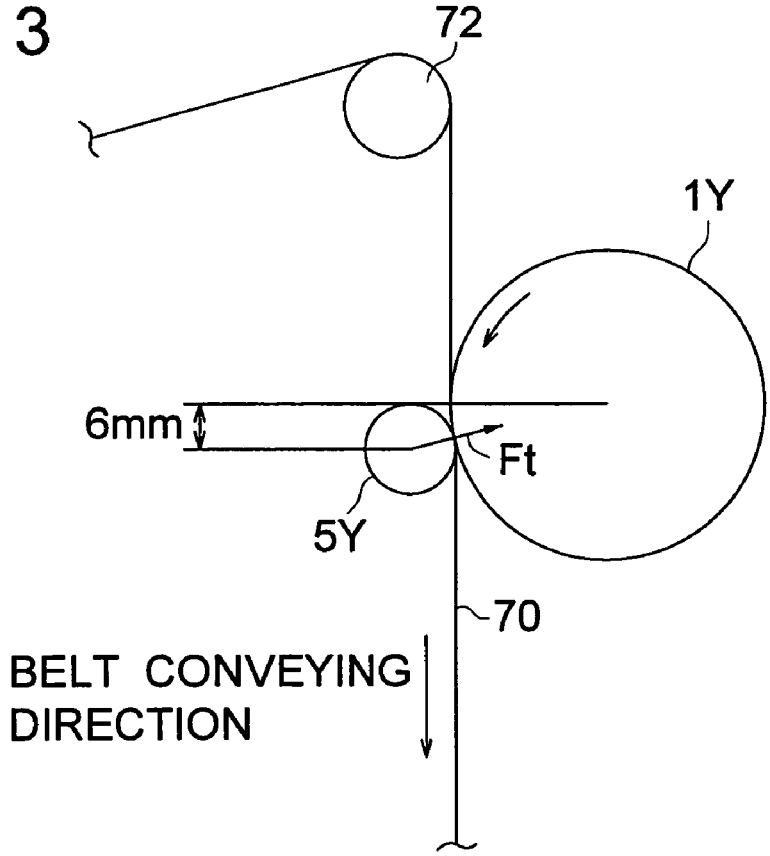
FIG. 3 is an arrangement diagram showing an example of the position relationship between a photoreceptor, an endless-belt shape intermediate transfer member, and a primary transfer roller.

FIG. 3 is an arrangement drawing showing a positional relationship of a photoreceptor, an endless belt-form intermediate transfer member and a primary transfer roller. Primary transfer rollers 5Y, 5M, 5C and 5K are pressed from behind endless belt-form intermediate transfer member 70 as an intermediate transfer member against each photoreceptor 1Y, 1M, 1C and 1K; and primary transfer rollers 5Y, 5M, 5C and 5K are arranged more down-stream, in a rotating direction of a photoreceptor, than the contact point of endless belt-form intermediate transfer member 70 with each photoreceptor 1Y, 1M, 1C and 1K, when they are not in a state of being pressed, and pressed against each photoreceptor 1Y, 1M, 1C and 1K; as is shown in FIG. 3. At this time, in the constitution, endless belt-form transfer element 70 as an intermediate transfer member is bent so as to follow the outer circumference of each photoreceptor 1Y, 1M, 1C and 1K, and primary transfer rollers 5Y, 5M, 5C and 5K are arranged at most down-stream in the contact range of a photoreceptor with endless belt-form intermediate transfer member 70.

Figure 4:
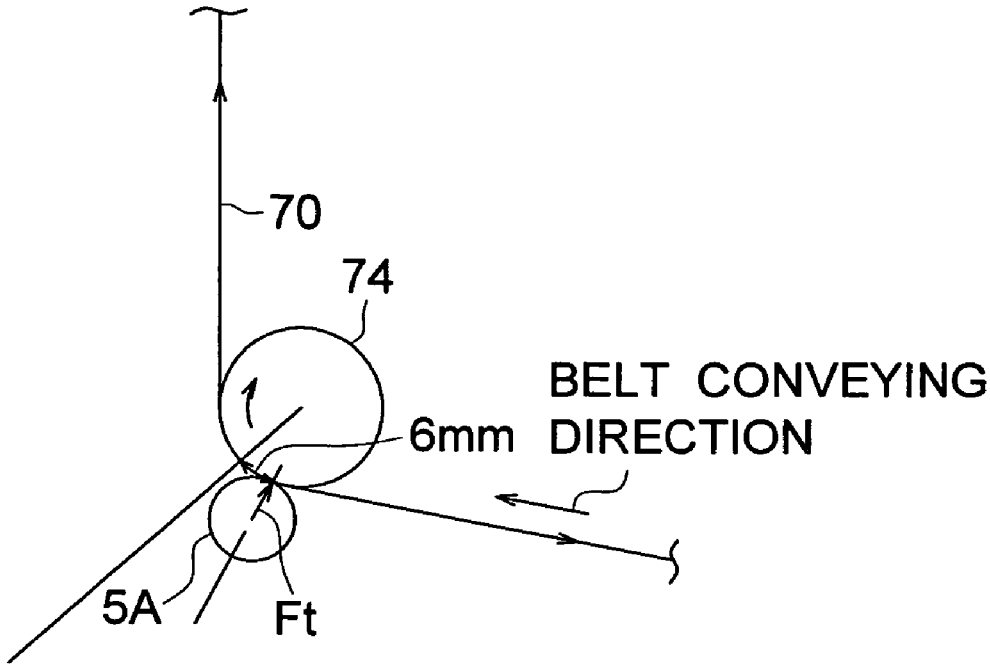
FIG. 4 is an arrangement diagram showing an example of the position relationship between a backup roller, the endless-belt shape intermediate transfer member, and a secondary transfer roller.

FIG. 4 is an arrangement drawing showing a positional relationship of a back-up roller, an endless belt-form transfer element and a secondary transfer roller. Secondary transfer roller 5A is preferably arranged, as is shown in FIG. 4, at upper-stream in a rotating direction of back-up roller 74, than the center of a contact portion of endless belt-form intermediate transfer member 70 as an intermediate transfer member, with back-up roller 74, when they are not in a state of being pressed by secondary transfer roller 5A.

As an intermediate transfer member, utilized are polymer films such as polyimide, polycarbonate and PVdF, synthetic rubbers such as silicone rubber and fluorine-contained rubber, which having been made electric conductive by adding an electric conductive filler such as carbon black; either a drum-form or a belt-form is applicable, however, a belt-form is preferable with respect to latitude in apparatus design.

It is preferable that surface of an intermediate transfer member has roughness. By setting a ten point surface roughness Rz of an intermediate transfer member 0.5–2 μm, a surface energy lowering agent supplied to the photoreceptor is taken in the surface of the intermediate transfer member, whereby toner adhesion strength on an intermediate transfer member is decreased to make improvement of a transfer ratio of secondary toner transfer from an intermediate transfer member to a recording sheet easier. An effect of the ten-point surface roughness Rz of the intermediate transfer member is larger than that of the photoreceptor.

The image forming method is described by referring to FIGS. 1 to 4 employing intermediate transfer member. This may be applied to an apparatus in which a toner image on a photoreceptor is transferred to a recording medium directly.

The image forming apparatus having unitized intermediate transfer member is described above, however, other unitized member, such as developer members, may be preferably applied to the apparatus.

EXAMPLES

The present invention is described in detail referring examples by showing the embodiment concretely below. In the followings, "part" is represents "parts by weight".

Example 1

Preparation of Photoreceptor 1A

<Interlayer>

| | |
|---|---|
| Polyamide resin, Amilan CM-8000 (Toray Co., Ltd.) | 60 parts |
| Inorganic fine particle, titanium oxide SMT500SAS (Teika Co., Ltd, surface treated by silica, alumina, and methyl hydrogen polysiloxane) | 180 parts |
| Methanol | 1600 parts |
| 1-butanol | 400 parts |

The above components were mixed and dissolved to prepare an interlayer coating liquid. The coating liquid was coated by an immersion method on the cylindrical aluminum substrate and dried. Thus an interlayer with a thickness of 1.0 μm was prepared.

<Charge Generation Layer>

| | |
|---|---|
| Titanylphthalocyanine (The highest peak of Bragg angle 2θ of 27.3° for Cu—Kα characteristic X-ray diffraction) | 60 parts |
| Silicone resin solution, 15% xyrene/butanol solution of KR5240 (Shin'etsu Kagaku Co., Ltd.) | 700 parts |
| 2-Butanone | 2000 parts |

The above components were mixed and dispersed for 10 hours using a sand mill to prepare a charge generation layer coating liquid. The coating liquid was coated onto the inter layer by the immersion method and dried. Thus a charge generation layer of 0.3 μm was formed.

<Charge Transfer Layer>

| | |
|---|---|
| Charge transfer material (Exemplified Compound 21A) | 150 parts |
| Binder resin, bis-phenol Z type polycarbonate Eupiron Z300 (Mitsubishi Gas Chemical Company Inc.) | 300 parts |
| Antioxidant, Sanol LS2626 (Sankyo Co., Ltd.) | 1.7 parts |
| Tetrahydrofuran | 2000 parts |

The above components were mixed and dissolved to prepare a charge transfer layer coating liquid. The coating liquid was coated on the charge generation layer by the immersion method and dried for 40 minutes at 100° C. to form a charge transfer layer of 22 μm. Thus Photoreceptor 1A was prepared.

Preparation of Photoreceptors of 2A and 3A

Photoreceptors 2A and 3A were prepared in the same manner as in Photoreceptor 1A except that the charge generation compound, the charge transfer compound, the amounts of the compounds, and the thickness of the charge transfer layer were changed as shown in Table 1.

Preparation of Photoreceptor 4A

Photoreceptor 4A was prepared in the same manner as in Photoreceptor 1A except that the charge transfer material or the compound of Synthesizing Example 1 was replaced by the component of n=1 synthesized by the conventional method. The purity of the component was larger than 99%.

Preparation of Photoreceptor 5A

The compound of Synthesizing Example 1 was separated by liquid chromatography into each component and a mixture of 50% of the component of n=1 and 50% of that of n=2 of Compound 21A was prepared. Then Photoreceptor 5A was prepared in the same manner as in Photoreceptor 1A except that the charge transfer material is replaced by the above mixture.

TABLE 1

| CGM and Photoreceptor | Chemical Structure and Components | | | | | | | | | | | |
|---|---|---|---|---|---|---|---|---|---|---|---|---|
| No. | CGM (*) | n = 0 | n = 1 | n = 2 | n = 3 | n = 4 | n = 5 | n = 6 | n = 7 | n = 8 | x + y | M.W. (**) |
| 1A | 21A | 27.4 | 44.8 | 20.1 | 6.3 | 1.4 | 0.0 | 0.0 | 0.0 | 0.0 | 72.2 | 1,475 |
| 2A | 21A | 33.4 | 46.8 | 15.0 | 4.0 | 0.8 | 0.0 | 0.0 | 0.0 | 0.0 | 80.2 | 1,314 |
| 3A | 21A | 30.1 | 45.4 | 16.7 | 6.0 | 1.8 | 0.0 | 0.0 | 0.0 | 0.0 | 75.5 | 1,194 |
| 4A | 21A | 0.0 | 100 | 0.0 | 0.0 | 0.0 | 0.0 | 0.0 | 0.0 | 0.0 | 100 | 643 |
| 5A | 21A | 0.0 | 50 | 50 | 0 | 0.0 | 0.0 | 0.0 | 0.0 | 0.0 | 100 | 1,263 |

CGM (*): Chemical Structure No.
M.W. (**): Average Molecular Weight (x+y) is the sum of the content in percent of the compound having the largest content and the content in percent of the compound having the second content.

The distribution or content ratio of n of the chain structure of the charge transfer material is determined according to the ratio of the area of high speed liquid chromatograph GPC. The average molecular weight Mw is the weight average molecular weight in terms of polystyrene determined by gel permeation chromatography.

Production Example 1, (Example of Emulsion Polymerization Method)

Added to 10.0 liters of pure water was 0.90 kg of sodium n-dodecylsulfate, and was subsequently dissolved. Gradually added to the resulting solution were 1.20 kg of Regal 330R (carbon black manufactured by Cabot Corp.). The resulting mixture was suitably stirred for one hour, and thereafter, was continuously dispersed for 20 hours employing a sand grinder (a medium type homogenizer). The resulting dispersion was designated as "Colorant Dispersion 1". A solution comprised of 0.055 kg of sodium dodecylbenzenesulfonate and 4.0 liters of deionized eater was designated as "Anionic Surface Active Agent Solution A".

A solution comprised of 0.014 g of a nonylphenolpolyethylene oxide 10 mole addition product and 4.0 liters of deionized water was designated as "Nonionic Surface Active Agent Solution B". A solution prepared by dissolving 223.8 g of potassium persulfate in 12.0 liters of deionized water was designated as "Initiator Solution C".

Charged into a 100 liter GL (glass lined) reaction vessel fitted with a thermal sensor were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent A", and the total amount of "Nonionic Surface Active Agent Solution B", and the resulting mixture was stirred. Subsequently, 44.0 liters of deionized water were added.

When the resulting mixture reached 75° C., the total amount of "Initiator Solution C" was added. Thereafter, while maintaining the resulting mixture at 75±1° C., a mixture consisting of 12.1 kg of styrene, 2.88 kg of n-butyl acrylate, 1.14 kg of methacrylic acid, and 548 g of t-dodecylmercaptan was added dropwise. After said dropwise addition, the resulting mixture was heated to 80±1° C. and stirred for 6 hours while maintaining said temperature. Subsequently, the temperature was lowered to no more than 40° C. and stirring was stopped. The resulting products were filtered employing a pole filter and the resulting filtrate by Pall Filter was designated as "Latex (1)-A".

The resinous particles in said Latex (1)-A exhibited a glass transition temperature of 57° C. and a softening point of 121° C., a weight average molecular weight of 12,700 regarding the molecular weight distribution, and a weight average particle diameter of 120 nm.

Further, a solution prepared by dissolving 0.055 kg of sodium dodecylbenzenesulfonate in 4.0 liters of deionized water was designated as "Anionic Surface Active Agent Solution D". A solution prepared by dissolving 0.014 kg of a nonylphenolpolyethylene oxide 10 mole addition product in 4.0 liters of deionized water was designated as "Nonionic Surface Active Agent Solution E".

A solution prepared by dissolving 200.7 g of potassium persulfate (manufactured by Kanto Chemical Company Inc.) in 12.0 liters of deionized water was designated as "Initiator Solution F".

Charged into a 100 liter GL reaction vessel fitted with a thermal sensor, a cooling pipe, a nitrogen gas inlet, and a comb shaped baffle, were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent D", and the total amount of "Nonionic Surface Active Agent Solution E", and the resulting mixture was stirred. Subsequently, 44.0 liters of deionized water were added. When the heated resulting mixture reached 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. After said dropwise addition, the resulting mixture was maintained at 72±2° C. and stirred for 6 hours while maintaining said temperature. Subsequently, the temperature was raised to 80±2° C., and stirring was carried out for 12 more hours while controlling the temperature within said range. The temperature was then lowered to no more than 40° C., and stirring was stopped. The resulting products were filtered employing a Pall filter and the resulting filtrate was designated as "Latex (1)-B".

The resinous particles in said Latex (1)-B exhibited a glass transition temperature of 58° C. and a softening point of 132° C., a weight average molecular weight of 245,000 regarding the molecular weight distribution, and a weight average particle diameter of 110 nm.

A solution prepared by dissolving 5.36 g of sodium chloride as the salting-out agent in 20.0 liters of deionized water was designated as "Sodium Chloride Solution G".

A solution prepared by dissolving 1.00 g of a fluorine based nonionic surface active agent in 1.00 liter of deionized water was designated as "Nonionic Surface Active Agent Solution H".

Charged into a 100 liter SUS reaction vessel fitted with a thermal sensor, a cooling pipe, a nitrogen gas inlet, a particle diameter and shape monitoring device, were 20.0 kg of Latex (1)-A and 5.2 kg of Latex (1)-B as prepared above, 0.4 kg of Colorant Dispersion 1, and 20.0 kg of deionized water, and the resulting mixture was stirred. Subsequently, the mixture was heated to 40° C., and said Sodium Chloride Solution G and 6.00 kg of isopropanol (manufactured by Kanto Chemical Company Inc.), and said Nonionic Surface Active Agent Solution G were added in this order. Thereafter, the resulting mixture was put aside for 10 minutes, and then heated to 85° C. over a period of 60 minutes. While being heated at 85±2° C. for the period of from 0.5 to 3 hours while stirring, the mixture was subjected to salting-out/fusion so that the particle diameter increased. Subsequently, the increase in the particle diameter was terminated by the addition of 2.1 liters of pure water.

Charged into a 5 liter reaction vessel fitted with a thermal sensor, a cooling pipe, and a particle diameter and shape monitoring device, were 5.0 kg of the coalesced particle dispersion as prepared above, and said dispersion was heated at 85±2° C. for a period of from 0.5 to 15 hours so as to control the particle shape. Thereafter, the resulting dispersion was cooled to no more than 40° C. and stirring was terminated. Subsequently, while employing a centrifuge, classification was carried out in the liquid medium utilizing a centrifugal sedimentation method, and filtration was carried out employing a 45 μm sieve. The resulting filtrate was designated as Coalesced Liquid. Subsequently, wet cake-like aspherical particles were collected from said Coalesced Liquid through filtration employing a Buchner's funnel, and then washed with deionized water.

The resulting non-spherical particles were dried at an air intake temperature of 60° C., employing a flash jet dryer, and subsequently dried at 60° C. employing a fluidized layer dryer. Externally added to 100 parts by weight of the obtained colored particles were 1 part by weight of fine silica particles and 0.1 part by weight of zinc stearate, and the resulting mixture was blended employing a Henschel mixer, whereby toners shown in the table below were obtained which were prepared employing the emulsion polymerization coalescence method.

Toners 1-1 through 1-6 shown in Table 2 were obtained by controlling the shape as well as the variation coefficient of the shape coefficient through controlling the rotation frequency of the stirrer as well as the heating time during said salting-out/fusion stage and the monitoring of the shape controlling process, and further regulating the particle diameter and the variation coefficient of the size distribution.

TABLE 2

| Toner No. | (*) (%) | (**) (%) | (***) (%) | (****) (μm) |
|---|---|---|---|---|
| 1-1 | 67.9 | 13.3 | 24.8 | 5.0 |
| 1-2 | 68.2 | 13.8 | 24.0 | 4.8 |
| 1-3 | 69.2 | 12.8 | 23.0 | 4.8 |
| 1-4 | 64.0 | 15.8 | 26.8 | 4.9 |
| 1-5 | 65.2 | 16.5 | 26.4 | 5.0 |
| 1-6 | 65.2 | 15.8 | 27.8 | 4.8 |

(*): Ratio having a shape coefficient of 1.2–1.6.
(**): Variation Coefficient of the shape coefficient
(***): Variation Coefficient of the number distribution.
(****): Volume average particle diameter.

<Evaluation>

Each of photoreceptors No. 1A to 5A was installed to a digital color printer having an intermediate transfer member of FIG. 1. An image of pixel rate 8% was printed on A4 size paper continuously under a high-temperature and a high humidity circumstances of 30° C. and 80% RH, and a low-temperature and a low humidity circumstances of 10° C. and 20% RH by the printer, and the printed sheets were evaluated. Evaluation items are evaluations for the character thinning of toner image and the scattering of character image, a staining of photoreceptor and intermediate transfer member, and an image sharpness evaluation. Evaluation items and criterion for evaluation are shown below.

Evaluation Item and Criterion for Evaluation

Scattering of Character Image

Instead of dot images constructing a character, a 10% halftone image was formed on the entire image surface, and the scattering of toner image around the dot was observed with a magnifying lens.

A: No scattering of toner image is observed.

B: Little scattering of toner image is observed.

C: A little scattering of toner image is observed (practically allowable).

D: Scattering of toner image is observed.

Image Sharpness

Under an environment of a high-temperature and a high-humidity, an image of a thin line was printed, reproducibility and sharpness of the thin line image were evaluated based on character collapse of the thin line image. Character images of 3 points and 5 points were formed, the character images were evaluated with the following judgment criteria.

A: Both of the 3 point and 5 point character images are clear, and readable easily.

B: The 3 point character image is partially hardly readable in part, and the 5 point character image is clear and readable easily.

C: The 3 point character image is hardly readable in part, and practically not preferable.

D: Both 3 point and 5 point character images are almost not readable.

Character Thinning

An original image having line images of 0.1 mm and 0.2 mm width was copied, under an environment of a low-temperature and a low-humidity, and evaluation was conducted.

A: Line width of copied image is reproduced more than 75% of original image.

B: Line width of copied image is reproduced 75–40% of original image.

C: Line width of copied image is reproduced not more than 40% of original image, and problematic practically.

D: Line width of copied image is not determined how much percent is reproduced of original image.

Staining of Photoreceptor and Intermediate Transfer Member

After evaluation of the under condition of a low-temperature and low-humidity and a high-temperature and normal-humidity mentioned above, further 100,000 sheets were printed continuously under both a low-temperature and low-humidity and a high-temperature and normal-humidity, then the photoreceptor and the intermediate transfer member was pulled out and staining was evaluated by eye watching.

A: No toner filming or staining was observed.

B: Little toner filming or staining was observed.

C: A little toner filming or staining was observed (not preferable practically).

D: Toner filming and staining was observed.

Other Conditions for Evaluation

Line speed L/S of image formation: 250 mm/s

An electrostatic charge condition of photoreceptor (60 mm diameter): electro potential of non-image section was detected with a potential sensor, and a feed back control was conducted in such a manner that a control range was −500V to −900V and the surface potential of the photoreceptor was controlled within a range of −50 to 0 V when an entire exposure was conducted. Imagewise exposure light: semiconductor laser (wavelength: 780 nm) Intermediate transfer member: A seamless endless belt-shaped intermediate transfer member 70 was used, and the belt was made of a semi conductive resin having a volume resistance ratio of $1\times10^8$ Ωcm. Rz of 0.9 μm was used.

Primary Transfer Condition

A primary transfer roller (5Y, 5M, 5C, 5K of FIG. 1, each having 6.05 mm diameter): the structure in which a metal core was provided with elastic rubber: Surface specific resistance $1\times10^6$ Ω, and a transfer voltage was applied.

Secondary Transfer Condition

A back-up roller 74 and a secondary transfer roller 5A were disposed to put an endless belt-shaped intermediate transfer member 70 as the intermediate transfer member between them, the resistance value of the back-up roller 74 is $1\times10^6$ Ω, the resistance value of the secondary transfer roller as a secondary transfer means is $1\times10^6$ Ω, and a constant current control (about 80 μA) was conducted. A distance Y on an intermediate transfer member from the first contact point between the intermediate transfer member and a photoreceptor to the first contact point between the intermediate transfer member and a photoreceptor for a next color was made 95 mm.

The outer circumferential length (circumferential length) of drive roller 71, guide roller 72,73 and back-up roller 74 for use in secondary transfer was made 31.67 mm (=95 mm/3), and the outer circumferential length of tension roller 76 was made 23.75 mm (=95 mm/4).

The outer circumferential length of a primary transfer roller was made 19 mm (=95 mm/5).

A secondary transfer roller (5A of FIG. 1): with the structure in which the core metal is provided with elastic rubber: a transfer voltage was applied.

Cleaning Condition for the Photoreceptor

Cleaning blade: Urethane rubber cleaning blade was made contact with the photoreceptor in a direction counter to the rotation of the photoreceptor.

A cleaning brush: Three kinds of brush having conductive acryl resin, bristles density of $3\times10^3/cm^2$, bite-in amount (deformed amount) of 0.6 mm, 0.1 mm and 1.3 mm, respectively.

Cleaning Condition for Intermediate Transfer Member)

Cleaning blade of urethane rubber was made contact with the intermediate transfer member in a direction counter to intermediate rotation direction.

Fixing is a heat fixing method by a fixing roller in which a heater was arranged inside of a roller.

The result is summarized in Table 3.

TABLE 3

| Test No. | Photo-receptor No. | Toner No. | Character Thinning | Toner Scattering | Staining (*) | Sharpness |
|---|---|---|---|---|---|---|
| 1-1 | 1A | 1-1 | A | A | A | A |
| 1-2 | 1A | 1-2 | A | A | A | A |
| 1-3 | 1A | 1-3 | A | A | A | A |
| 1-4 | 2A | 1-4 | C | C | C | D |
| 1-5 | 2A | 1-5 | D | D | B | C |
| 1-6 | 2A | 1-6 | D | D | B | D |
| 1-7 | 3A | 1-1 | A | A | A | A |
| 1-8 | 3A | 1-2 | A | A | A | A |
| 1-9 | 3A | 1-3 | A | A | A | A |
| 1-10 | 4A | 1-2 | B | B | D | C |
| 1-11 | 5A | 1-3 | C | C | D | B |
| 1-12 | 1A | 1-4 | C | C | D | D |
| 1-13 | 1A | 1-5 | D | D | B | B |
| 1-14 | 1A | 1-6 | D | D | B | D |

(*): Staining on the photoreceptor and the intermediate member

Though samples 1-1 to 1-3,1-7 to 1-9 show good characteristics in every evaluation items, comparative samples Nos. 1-4 to 1-6, and 1-10 to 1-14 are practically problematic, as can be appreciated from Table 3.

Example 2

The photoreceptors 1B to 6B and 1C to 5C prepared by the similar way as Example 1, employing charge generation materials 1B to 6B and 1C to 5C shown in Tables 4 and 5, were employed.

TABLE 4

| CGM and Photoreceptor | Chemical Structure and Components | | | | | | | | | | | |
|---|---|---|---|---|---|---|---|---|---|---|---|---|
| No. | CGM (*) | n = 0 | n = 1 | n = 2 | n = 3 | n = 4 | n = 5 | n = 6 | n = 7 | n = 8 | X + y | M.W. (**) |
| 1B | 12B | 24.3 | 44.4 | 21.5 | 7.2 | 2.3 | 0.3 | 0.0 | 0.0 | 0.0 | 68.7 | 1,542 |
| 2B | 11B | 32.5 | 45.0 | 16.0 | 5.3 | 1.2 | 0.0 | 0.0 | 0.0 | 0.0 | 77.5 | 1,297 |
| 3B | 12B | 24.3 | 44.4 | 21.5 | 9.8 | 0.0 | 0.0 | 0.0 | 0.0 | 0.0 | 68.7 | 1,542 |
| 4B | 12B | 24.3 | 44.7 | 23.8 | 7.2 | 0.0 | 0.0 | 0.0 | 0.0 | 0.0 | 68.7 | 1,542 |
| 5B | 11B | 0.0 | 100 | 0.0 | 0.0 | 0.0 | 0.0 | 0.0 | 0.0 | 0.0 | 100 | 672 |
| 6B | 11B | 0.0 | 0.0 | 50 | 50 | 0.0 | 0.0 | 0.0 | 0.0 | 0.0 | 100 | 1,670 |

CGM (*): Chemical Structure No.

M.W. (**): Average Molecular Weight

TABLE 5

| CGM and Photoreceptor | Chemical Structure and Components | | | | | | | | | | | |
|---|---|---|---|---|---|---|---|---|---|---|---|---|
| No. | CGM (*) | n = 0 | n = 1 | n = 2 | n = 3 | n = 4 | n = 5 | n = 6 | n = 7 | n = 8 | X + y | M.W. (**) |
| 1C | 17C | 14.8 | 25.1 | 27.4 | 18.1 | 9.9 | 3.4 | 1.1 | 0.2 | 0.0 | 52.5 | 910 |
| 2C | 17C | 23.5 | 40.1 | 21.5 | 10.4 | 3.8 | 0.7 | 0.0 | 0.0 | 0.0 | 63.6 | 660 |
| 3C | 38C | 6.9 | 13.8 | 20.2 | 21.1 | 17.1 | 11.0 | 5.9 | 2.7 | 1.3 | 41.3 | 1,186 |
| 4C | 17C | 0.0 | 100 | 0.0 | 0.0 | 0.0 | 0.0 | 0.0 | 0.0 | 0.0 | 100 | 468 |
| 5C | 17C | 0.0 | 0.0 | 0.0 | 50 | 50 | 0.0 | 0.0 | 0.0 | 0.0 | 100 | 956 |

CGM (*): Chemical Structure No.
M.W. (**): Average Molecular Weight

The toners were prepared as follows.

Toner Preparation 2: Example of Suspension Polymerization

A mixture consisting of 165 g of styrene, 35 g of n-butyl acrylate, 10 g of carbon black, 2 g of di-t-butylsalicylic acid metal compound, 8 g of a styrene-methacrylic acid copolymer, and 20 g of paraffin wax (having an mp of 70° C.) was heated to 60° C., and uniformly dissolve-dispersed at 12,000 rpm employing a TK Homomixer (Tokushu Kika Kogyo Co., Ltd.). Added to the resulting dispersion were 10 g of 2,2'-azobis(2,4-valeronitile) as the polymerization initiator and dissolved to prepare a polymerizable monomer composition. Subsequently, 450 g of 0.1 M sodium phosphate were added to 710 g of deionized water, and 68 g of 1.0 M calcium chloride were gradually added while stirring at 13,000 rpm, employing a TK Homomixer, whereby a dispersion in which tricalcium phosphate was prepared. Said polymerizable monomer composition was added to said dispersion and stirred at 10,000 rpm for 20 minutes employing a TK Homomixer, whereby said polymerizable monomer composition was granulated. Thereafter, the resulting composition underwent reaction at a temperature of from 75 to 95° C. for a period of from 5 to 15 hours. Tricalcium phosphate was dissolved employing hydrochloric acid and then removed. Subsequently, while employing a centrifuge, classification was carried out in a liquid medium utilizing a centrifugal sedimentation method. Thereafter, filtration, washing and drying were carried out. Externally added to 100 parts by weight of the obtained colored particles were 1.0 part by weight of fine silica particles, and the resulting mixture was blended employing a Henschel mixer, whereby a toner was obtained which was prepared employing the suspension polymerization method.

Toner samples 2-1 to 2-4, in which a shape coefficient, variation of the shape coefficient which were obtained by controlling the temperature of reaction liquid, rotational frequency of stirring, and heating period during polymerization with monitoring, were controlled, and particle diameter and a variation coefficient of particle diameter distribution were optionally adjusted, were prepared as shown in Table 4.

Toner Preparation 3: Example of a Pulverization Method

Toner raw materials comprised of 100 kg of a styrene-n-butyl acrylate copolymer resin, 10 kg of carbon black, and 4 kg of polypropylene were preliminary mixed employing a Henschel mixer, and the resulting mixture was fuse-kneaded employing a biaxial extruder, preliminary pulverized employing a hammer mill, and further pulverized employing a jet method pulverizing unit. The resulting powder was dispersed (for 0.05 second at 200 to 300° C.) into the heated air flow of a spray drier to obtain shape adjusted particles. The resulting particles were repeatedly classified employing a forced air classifying unit until the targeted particle diameter distribution was obtained. Externally added to 100 weight parts of the obtained colored particles was one part of fine silica particles and mixed employing a Henschel mixer. Thus toner samples 2-5 to 2-7, prepared employing the pulverization method, were obtained.

TABLE 6

| Toner No. | Percentage of Particles (*) | Variation Coefficient (**) | Variation Coefficient (***) | Particle Diameter (****) |
|---|---|---|---|---|
| 2-1 | 66.7 | 13.3 | 24.2 | 5.7 |
| 2-2 | 64.2 | 15.2 | 26.6 | 8.8 |
| 2-3 | 66.9 | 17.8 | 26.6 | 8.9 |
| 2-4 | 68.3 | 15.5 | 29.0 | 8.7 |
| 2-5 | 68.1 | 15.8 | 24.4 | 5.8 |
| 2-6 | 67.8 | 16.5 | 26.2 | 5.6 |
| 2-7 | 67.7 | 15.5 | 28.2 | 6.7 |

(*): Percentage of Particles having shape coefficient of 1.2 to 1.6 in %.
(**): Variation Coefficient of shape coefficient in %.
(***): Variation Coefficient of particle number distribution in %.
(****): Volume average Particle Diameter in μm.

The same evaluation as Example 1 was conducted to obtain result summarized in the following Table.

TABLE 7

| Test No. | Photo-receptor No. | Toner No. | Character Thinning | Toner Scattering | Staining (*) | Sharpness |
|---|---|---|---|---|---|---|
| 2-1 | 1B | 2-1 | A | A | A | B |
| 2-2 | 2B | 2-2 | C | B | C | D |
| 2-3 | 3B | 2-3 | D | C | C | D |
| 2-4 | 4B | 2-4 | D | B | C | D |
| 2-5 | 1C | 2-5 | B | A | A | A |
| 2-6 | 2C | 2-6 | C | D | D | C |
| 2-7 | 3C | 2-7 | C | C | D | D |
| 2-8 | 5B | 2-1 | C | A | D | D |
| 2-9 | 6B | 2-1 | C | C | D | D |
| 2-10 | 4C | 2-1 | C | C | D | D |
| 2-11 | 5C | 2-1 | C | C | D | D |

(*): Staining on the photoreceptor and the intermediate member

Though samples 2-1 and 2-5 show good characteristics in every evaluation items, samples Nos. 2-2 to 2-4, and 2-6 to 2-11 are practically problematic, as can be appreciated from table 3.

What is claimed is:

1. An image forming method comprising;

developing a latent image on a photoreceptor by a developer containing a toner to form a toner image, wherein the toner comprises at least 65% by number of toner, particles having a shape coefficient of 1.2 to 1.6, and the toner has a variation coefficient of the shape coefficient is 4 to 16%, and a number variation coefficient in number particle size distribution of 8 to 27 percent; and the photoreceptor has a photosensitive layer containing a charge generation material and a charge transfer material, and charge generation material contains a mixture compound represented by Formula 1 in which n has a range of distribution and (x+y) is not more than 99% when x represents the ratio of a component having the largest content and y represents the ratio of a component having the second content, X-(CTM-group)$_n$-Y Formula 1 wherein CTM-group is a charge transfer group; X and Y are each a hydrogen atom, a halogen atom or a mono-valent organic group, X and Y is the same or different; and n is an integer of from 0 to 10, provided that n is 1 to 10 when both X and Y are a hydrogen or halogen atom at the same time.

2. The image forming method of claim 1, wherein the CTM-group is

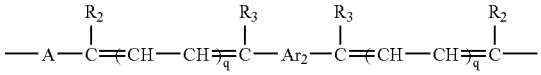

wherein $Ar_2$ is a substituted or unsubstituted di-valent aromatic group, a divalent furan or thiophene group; $R_2$ and $R_3$ are each a hydrogen atom, a substituted or unsubstituted alkyl group or a substituted or unsubstituted monovalent aromatic group; A is a divalent group having a triarylarnino group or a group represented by Formula 3; each of the plural $R_2$ and $R_3$ maybe the same with or different from each other, and q is independently an integer of 0 or 1;

Formula 3

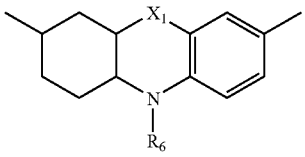

wherein $X_1$ is a single bond, an alkylene group, an oxygen atom or a sulfur atom; and $R_6$ is a substituted or unsubstituted alkyl group or substituted or unsubstituted aromatic group.

3. The image forming method of claim 1, wherein the X is

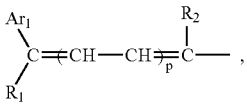

wherein $Ar_1$ is a substituted or unsubstituted mono-valent aromatic group; $R_1$ and $R_2$ are each a hydrogen atom, a substituted or unsubstituted alkyl group or a substituted or unsubstituted mono-valent aromatic group; and p is an integer or 0 or 1.

4. The image forming method of claim 1, wherein the Y is

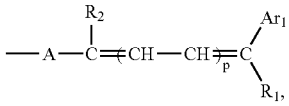

wherein $Ar_1$ is a substituted or unsubstituted mono-valent aromatic group; $R_1$ and $R_2$ are each a hydrogen atom, a substituted or unsubstituted alkyl group or a substituted or unsubstituted mono-valent aromatic group; A is a di-valent group having a triarylamino group or a group represented by Formula 3; and p and q are each an integer of 0 or 1, Formula 3

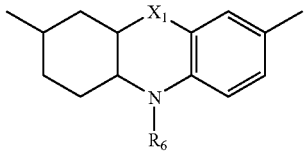

wherein $X_1$ is a single bond, an alkylene group, an oxygen atom or a sulfur atom; and $R_6$ is a substituted or unsubstituted alkyl group or substituted or unsubstituted aromatic group.

5. The image forming method of claim 1, wherein CTM-group is

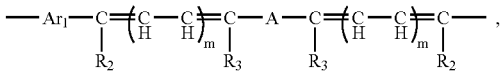

X is 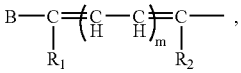 , and

Y is 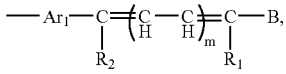

wherein $Ar_1$ is a substituted or unsubstituted di-valent aromatic group, a di-valent furan or thiophene group or a group represented by Formula 2; $R_1$ through $R_3$ are each a hydrogen atom, a substituted or unsubstituted alkyl group or a substituted or unsubstituted mono-valent aromatic group; A is a divalent group having a triarylamino group or a group represented by Formula 3; and B is a substituted or unsubstituted mono-valent aromatic group, plural B, $R_1$, $R_2$ and $R_3$ each may be the same as or different from each other; and m is an integer of 0 or 1.

6. The image forming method of claim 1, wherein CTM-group is

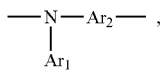

X is R—, and
Y is

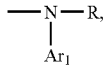

wherein $Ar_1$ is a substituted or unsubstituted mono-valent aromatic group; $Ar_2$ is a substituted or unsubstituted di-valent aromatic group, a di-valent heterocyclic group, or a group represented by Formula 8; and R is a substituted or unsubstituted alkyl group or a substituted or unsubstituted mono-valent aromatic group; and plural $Ar_1$, $Ar_2$ and R are each different from each other, Formula (8)

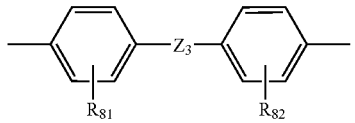

wherein $Z_3$ is an oxygen atom, a sulfur atom, a —CH═CH— group or a —$CH_2$—$CH_2$— group; and $R_{81}$ and $R_{82}$ are each a hydrogen atom or an alkyl group having from 1 to 4 carbon.

7. The image forming method of claim 1, wherein the photoreceptor comprises a charge generation layer and a charge transfer layer provided on an electroconductive substrate.

8. The image forming method of claim 1, wherein the photoreceptor comprises a protective layer at outermost of the photoreceptor.

9. The image forming method of claim 1, comprising transferring the toner image to a recording member.

10. The image forming method of claim 9, wherein the transferring step comprises transferring the toner image on the photoreceptor to an intermediate transfer member and then transferring the toner image on the intermediate transfer member to the recording member.

11. The image forming method of claim 1, wherein a molecular weight of the compound represented by the Formula 1 is 650 to 2,500.

12. The image forming method of claim 1, wherein the toner particles have a particle distribution characteristics that a ratio (Dv50/Dp50) is 1.0 to 1.15, and a ratio (Dv75/Dp75) is 1.0 to 1.20, wherein Dv50 is 50% volume particle diameter of the toner particles, Dp50 is 50% number particle diameter of the toner particles, Dv75 is a cumulative 75% volume particle diameter from the largest particle diameter of the particles, and Dp75 is cumulative 75% number particle diameter from the largest particle diameter of the particles.

13. The image forming method of claim 1, wherein the toner particles have a 50% volume particle diameter Dv50 of 3.0 to 8.0 μm.

14. The image forming method of claim 1, wherein the toner is a polymerization toner prepared by a polymerization method.

15. The image forming method of claim 1, comprising rotating the photoreceptor at a line speed on the photoreceptor surface of 250 mm/sec or more.

16. The image forming method of claim 1, wherein the variation coefficient is 6 to 14% and the number variation coefficient in the number particle size distribution is not more than 10 to 25 percent.

17. A photoreceptor which is used for the image forming method of claim 1.

18. An image forming unit which is used for the image forming method of claim 1, the unit comprises the photoreceptor and at least one of a charging member which charges the photoreceptor uniformly, an exposing member which exposes the photoreceptor to form a latent image, a developing member to develop the latent image by a developer containing a toner to form a toner image, a transferring member to transfer the toner image to an recording member, and a fixing member fixing the toner image.

19. The image forming method of claim 1, wherein x+y in the Formula 1 satisfies a formula of:

$$90\% \geqq x+y \geqq 30\%.$$

* * * * *